US009852841B2

(12) United States Patent
Sakiyama et al.

(10) Patent No.: US 9,852,841 B2
(45) Date of Patent: Dec. 26, 2017

(54) COIL STRUCTURE, TRANSFORMER, AND POWER CONVERTER

(71) Applicant: Panasonic Intellectual Property Management Co., Ltd., Osaka (JP)

(72) Inventors: Kazuyuki Sakiyama, Osaka (JP); Akira Kato, Osaka (JP); Takehiko Yamakawa, Osaka (JP); Eiji Takahashi, Nara (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 265 days.

(21) Appl. No.: 14/596,446

(22) Filed: Jan. 14, 2015

(65) Prior Publication Data

US 2015/0213948 A1 Jul. 30, 2015

(30) Foreign Application Priority Data

Jan. 27, 2014 (JP) ..... 2014-011966

(51) Int. Cl.
*H01F 27/28* (2006.01)
*H01F 27/30* (2006.01)
*H01F 41/061* (2016.01)

(52) U.S. Cl.
CPC ..... *H01F 27/2847* (2013.01); *H01F 27/303* (2013.01); *H01F 27/306* (2013.01); *H01F 41/061* (2016.01)

(58) Field of Classification Search
USPC ..... 336/222, 220, 223, 182, 183
See application file for complete search history.

(56) References Cited

U.S. PATENT DOCUMENTS 2,378,884 A * 6/1945 Seifert ..... H01F 27/2852 29/602.1
3,543,194 A * 11/1970 Kassabgi ..... H01F 17/0013 333/156
5,274,904 A * 1/1994 Proise ..... B60L 13/04 156/226
6,087,922 A * 7/2000 Smith ..... H01F 27/2847 336/200
7,479,863 B2 * 1/2009 Kit ..... H01F 27/2847 29/602.1
8,661,654 B2 * 3/2014 Choi ..... G01N 29/2412 257/531

FOREIGN PATENT DOCUMENTS

JP 2011-009433 1/2011
JP 2012-100413 5/2012
JP 2013-021307 1/2013

* cited by examiner

*Primary Examiner* — Tsz Chan
*Assistant Examiner* — Kazi Hossain
(74) *Attorney, Agent, or Firm* — McDermott Will & Emery LLP

(57) ABSTRACT

A coil structure includes a conductor band and a first insulating plate. The conductor band turns around a coil axis in such a manner that the conductor band folds at a plurality of portions which form a plurality of folded portions. The first insulating plate includes a first edge portion which abuts along at least one of the plurality of folded portions. At least part of the conductor band is wound around the first insulating plate.

19 Claims, 31 Drawing Sheets

COIL STRUCTURE, TRANSFORMER, AND POWER CONVERTER

CROSS REFERENCES TO RELATED APPLICATIONS

This application claims priority to Japanese Patent Application No. 2014-011966, filed on Jan. 27, 2014, the contents of which are hereby incorporated by reference.

BACKGROUND

1. Technical Field

The present disclosure relates to a coil structure, a transformer including the coil structure, and a power converter including the coil structure.

2. Description of the Related Art

Japanese Unexamined Patent Application Publication No. 2011-9433 discloses a coil constituted by a sheet-like conductor wire. In this coil, the sheet-like conductor wire is folded in multiple portions such that the front side and the back side are alternately reversed. Japanese Unexamined Patent Application Publication No. 2013-21307 discloses a coil constituted by a band conductor sheet. In this coil, the band conductor sheet is folded over on the front side or the back side multiple times.

SUMMARY

In the related art, there is a demand for a coil structure which can be easily formed. Accordingly, one non-limiting and exemplary embodiment provides a coil structure which can be easily formed, a transformer including this coil structure, and a power converter including this coil structure.

One aspect of the present disclosure provides a coil structure including a conductor band and a first insulating plate. The conductor band includes a plurality of folded portions. The conductor band turns around a coil axis while being folded at a plurality of folded portions. The first insulating plate includes a first edge portion which abuts along at least one of the plurality of folded portions. At least part of the conductor band is wound around the first insulating plate.

These comprehensive and specific aspects may be implemented using a transformer, a power converter, a system, or a manufacturing method, or any combination of transformers, power converters, systems, and manufacturing methods.

A coil structure, a transformer, and a power converter according to one aspect of the present disclosure are easily manufactured.

Additional benefits and advantages of the disclosed embodiments will be apparent from the specification and drawings. The benefits and/or advantages may be individually provided by the various embodiments and features of the specification and drawings disclosure, and need not all be provided in order to obtain one or more of the same.

DETAILED DESCRIPTION (Underlying Knowledge Forming Basis of the Present Disclosure)

A coil constituted by magnet wire or litz wire is not suitable for a large-current use. In contrast, an edgewise coil constituted by conductive flat wire is suitable for a large-current use.

Figure 3A:
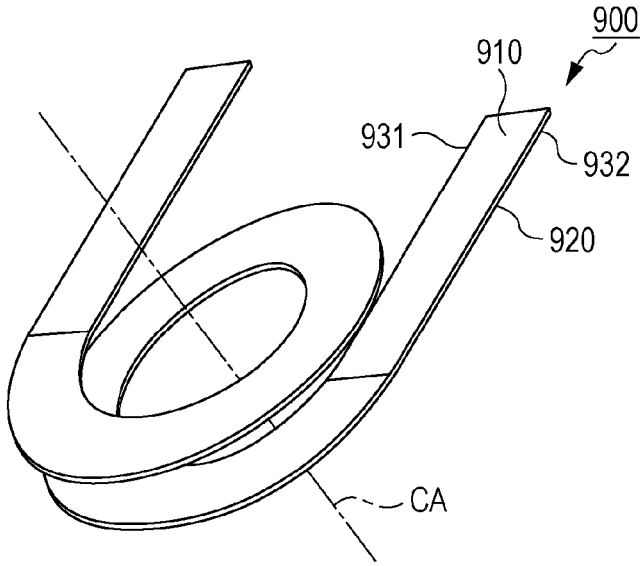
FIG. 3A is a schematic perspective view illustrating a known edgewise coil.

An edgewise coil is constituted by flat wire which turns around a coil axis, such as that shown in FIG. 3A. The edgewise coil includes an inner peripheral edge closer to the coil axis and an outer peripheral edge farther away from the coil axis. The inner peripheral portion, which is shorter than the outer peripheral edge, has a lower electrical resistance than the outer peripheral edge. Accordingly, a current is more likely to concentrate on the inner peripheral portion. As a result, large resistive losses may occur in the edgewise coil.

Japanese Unexamined Patent Application Publication Nos. 2011-9433 and 2013-21307 disclose known coils constituted by a band conductor sheet. Band conductor sheets are suitable for a large-current use, as in an edgewise coil. However, the shapes of coils formed based on these publications are not stably maintained. If a physical force, for example, a self-weight or another compressive force, is applied to the coil, some portions of the band conductor sheet of the coil may be in contact with each other. Accordingly, it is required for these coils to include an insulating film which covers the surface of the band conductor sheet. This increases the complexity of the manufacturing steps for these coils. Additionally, since an insulating film is folded together with the band conductor sheet, it may also be damaged.

In order to solve at least one of the above-described problems, the present inventors have conducted intensive and extensive study concerning a large-current-use coil which can be easily formed.

Overview of Embodiment

A coil structure according to an aspect of the present disclosure includes a conductor band and a first insulating plate. The conductor band includes a plurality of folded portions. The conductor band turns around a coil axis while being folded at a plurality of folded portions. The first insulating plate includes a first peripheral edge portion which abuts along at least one of the plurality of folded portions. At least part of the conductor band being wound around the first insulating plate.

With the above-described configuration, since at least part of the conductor band is wound around the first insulating plate, the shape of the coil structure is stably maintained. It is thus less likely that some regions of the conductor band of the coil structure will be in contact with each other. The first edge portion of the first insulating plate abuts along at least one of the plurality of folded portions. This enables a manufacturer manufacturing the coil structure to fold the conductor band by using the first edge portion. It is thus possible for the manufacturer to manufacture the coil structure easily.

In a coil structure according to an aspect of the present disclosure, the conductor band may include a first band surface and a second band surface opposite to the first band surface. The plurality of folded portions may include a plurality of first folded parts in each of which part of the first band surface is folded inwardly and a plurality of second folded parts in each of which part of the second band surface is folded inwardly. Each of the plurality of first folded parts and each of the plurality of second folded parts may be alternately disposed in a direction in which the conductor band extends.

With the above-described configuration, since the first and second folded parts are alternately disposed, the difference of the electrical length can be reduced in the coil structure, thereby decreasing the electrical resistance of the coil structure.

A coil structure according to an aspect of the present disclosure may further include a second insulating plate opposed to the first insulating plate. The conductor band may include a first band surface and a second band surface opposite to the first band surface. The plurality of folded portions may include a first folded part where part of the first band surface is folded inwardly and a second folded part where part of the second band surface is folded inwardly. The first insulating plate may include the first edge portion which abuts along the first folded part. The second insulating plate may include a second edge portion which abuts along the second folded part. The conductor band may include a band portion which extends between the first and second folded parts. The band portion may be sandwiched between the first and second insulating plates.

With the above-described configuration, a manufacturer can form the first folded part by using the first edge portion and form the second folded part by using the second edge portion. It is thus possible for the manufacturer to manufacture the coil structure easily.

A coil structure according to an aspect of the present disclosure may further include a plurality of insulating plates including the first insulating plate. The plurality of insulating plates may be as many as or greater than the plurality of folded portions.

With the above-described configuration, the plurality of folded portions may be wound around different insulating plates, thereby stably maintaining the shape of the coil structure.

A coil structure according to an aspect of the present disclosure may further include: a first plurality of insulating plates including the first insulating plate; a second plurality of insulating plates; and a second conductor band. The plurality of folded portions may include a plurality of first folded portions and a plurality of second folded portions. The conductor band may include a first turn section that turns around the coil axis through one revolution while being folded at the plurality of first folded portions, and a second turn section that turns around the coil axis through one revolution while being folded at the plurality of second folded portions, the second turn section being connected to one end of the first turn section. The first turn section may be wound around the first plurality of insulating plates, and the second turn section may be wound around the second plurality of insulating plates.

With the above-described configuration, the first plurality of insulating plates around which the first turn section is wound is different from the second plurality of insulating plates around which the second turn section is wound. Thus, it is less likely that the first turn section and the second turn section will be in contact with each other.

A coil structure according to an aspect of the present disclosure may further include a magnetic core extending in a direction along the coil axis. The first insulating plate may include a first axial hole through which the magnetic core passes, and the second insulating plate may include a second axial hole through which the magnetic core passes.

With the above-described configuration, due to the provision of a magnetic core inserted into the first and second axial holes, high inductance can be exhibited.

In a coil structure according to an aspect of the present disclosure, a configuration of the magnetic core may be complementary to a configuration of each of the first and second axial holes, and the configuration of each of the first and second axial holes may be noncircular.

With the above-described configuration, the insulating plate does not unnecessarily rotate around the magnetic core. It is thus possible for a manufacturer to manufacture the coil structure easily by using the magnetic core.

In a coil structure according to an aspect of the present disclosure, the first insulating plate may include a first principal surface and a second principal surface opposite to the first principal surface. The first edge portion may be part of a side surface which connects a contour of the first principal surface and a contour of the second principal surface.

With the above-described configuration, the conductor band is wound around the outer periphery of the first insulating plate. It is thus possible for a manufacturer to manufacture the coil structure easily.

In a coil structure according to an aspect of the present disclosure, the first insulating plate may include a through-hole through which the conductor band passes, and the first edge portion may be part of an inner peripheral surface which defines the through-hole.

With the above-described configuration, it is possible for a manufacturer or a designer to set a long creepage distance between the coil structure and a component disposed near the coil structure.

In a coil structure according to an aspect of the present disclosure, the conductor band may include a first band surface and a second band surface opposite to the first band surface. The plurality of folded portions may include a plurality of folded parts in each of which part of the first band surface is folded inwardly. The conductor band may include a turn section that turns around the coil axis through one revolution while being folded at the plurality of folded parts. The first insulating plate may include a plurality of edge portions including the first edge portion. The plurality of folded parts may be folded along the plurality of edge portions.

With the above-described configuration, it is possible for a manufacturer to wind the plurality of folded parts included in the turn section along the plurality of edge portions of the first insulating plate. It is thus possible to reduce the number of insulating plates around which the turn section is wound.

A coil structure according to an aspect of the present disclosure may further include a second insulating plate. The conductor band may include a band portion which extends between the plurality of folded portions. The band portion may be sandwiched between the first and second insulating plates. At least one of the first and second insulating plates may include a holding section for holding the band portion therein, at a position at which the holding section opposes the band portion.

With the above-described configuration, since the band portion is held within the holding section, the distance between the first and second insulating plates is decreased, thereby making it possible to form the coil structure thin.

In a coil structure according to an aspect of the present disclosure, the plurality of folded portions may include five or more folded portions. The conductor band may include a turn section that turns around the coil axis through one revolution while being folded at the five or more folded portions. Each of the plurality of first folded parts and each of the plurality of second folded parts may be alternately disposed in a direction in which the turn section extends.

With the above-described configuration, the effect of providing twisted wire is more noticeable, thereby decreasing the electrical resistance of the coil structure.

In a coil structure according to an aspect of the present disclosure, the plurality of folded portions may be a first plurality of folded portions, and the conductor band may be a first conductor band. The coil structure may further include a second conductor band that turns around the coil axis while being folded at a second plurality of folded portions. At least one of the second plurality of folded portions may be folded along the first edge portion.

With the above-described configuration, a manufacturer manufacturing the coil structure can fold the first and second conductor bands by using the first edge portion. It is thus possible for the manufacturer to manufacture the coil structure easily.

In a coil structure according to an aspect of the present disclosure, the plurality of folded portions may be a first plurality of folded portions, and the conductor band may be a first conductor band. The coil structure may further include a second conductor band that turns around the coil axis while being folded at a second plurality of folded portions. The first insulating plate may include a different edge portion from the first edge portion. At least one of the second plurality of folded portions may be folded along the different edge portion.

With the above-described configuration, a manufacturer manufacturing the coil structure can fold the first conductor band by using the first edge portion and the second conductor band by using the different edge portion. It is thus possible for the manufacturer to manufacture the coil structure easily.

In a coil structure according to an aspect of the present disclosure, the conductor band may include a band portion between two adjacent folded portions which are included in the plurality of folded portions, and a line normal to a principal surface of the band portion ("NL" shown in FIG. 4) may be parallel with the coil axis.

Even if a principal surface of the band portion is parallel with the coil axis, since a coil is formed by partially folding the conductor band at a plurality of portions, the difference of the electrical length of the entire coil can be reduced.

In a coil structure according to an aspect of the present disclosure, the insulating plate may have a higher folding stiffness than the conductor band.

With this configuration, the conductor band is more easily folded than the insulating plate. It is thus possible for a manufacturer to manufacture the coil structure easily.

A transformer according to an aspect of the present disclosure includes the above-described coil structure including the first conductor band and the second conductor band. When a current is supplied to one of the first and second conductor bands, an induced current is generated in the other one of the first and second conductor bands.

With the above-described configuration, it is possible to easily manufacture a transformer.

A power converter according to an aspect of the present disclosure includes the above-described coil structure and a switching circuit including a switching element.

With the above-described configuration, it is possible to easily manufacture a power converter.

A manufacturing method for a coil structure according to an aspect of the present disclosure includes: preparing a conductor band and at least one insulating plate including a first insulating plate; and winding the conductor band around the at least one insulating plate. In the step of winding, the conductor band is folded along a first edge portion of the first insulating plate to sandwich the first insulating plate between portions of the conductor band therebetween.

A manufacturing method for a coil structure according to an aspect of the present disclosure includes: preparing a conductor band and a plurality of insulating plates including a first insulating plate, a second insulating plate, and a third insulating plate; disposing the first insulating plate on a first band portion included in the conductor band; folding the conductor band along a first edge portion of the first insulating plate to form a first folded portion, a first remaining portion which is connected to the first folded portion at a position opposite the first band portion; disposing the second insulating plate on a second band portion included in the first remaining portion to sandwich the second band portion between the first and second insulating plates; folding the first remaining portion along a second edge portion of the second insulating plate to form a second folded portion and a second remaining portion which is connected to the second folded portion at a position opposite the second band portion; disposing the third insulating plate on a third band portion included in the second remaining portion to sandwich the third band portion between the second and third insulating plates; and folding the second remaining portion along a third edge portion of the third insulating plate to form a third folded portion and a third remaining portion which is connected to the third folded portion at a position opposite the third band portion.

A manufacturing method for a coil structure according to an aspect of the present disclosure includes: preparing, for example, a conductor band and an insulating plate; disposing the insulating plate on a first band portion included in the conductor band; folding the conductor band along a first edge portion of the insulating plate to form a first folded portion and a first remaining portion which is connected to the first folded portion at a position opposite the first band portion; folding the first remaining portion along a second edge portion of the insulating plate to form a second folded portion and a second remaining portion which is connected to the second folded portion at a position opposite a second band portion included in the first remaining portion; and folding the second remaining portion along a third edge portion of the insulating plate to form a third folded portion and a third remaining portion which is connected to the third folded portion at a position opposite a third band portion included in the second remaining portion.

Various embodiments of a coil structure, a transformer, and a power converter will be described below with reference to the accompanying drawings. The coil structure, the transformer, and the power converter may be clearly understood by the following description. The terms defining directions, such as "top", "bottom", "right", and "left" are given merely for clarifying a description. These terms are not to be interpreted definitely and restrictively. In all the drawings, the same or similar elements are designated by like reference numerals, and an explanation of the same or similar elements designated by a like reference numeral may be given only once.

All of embodiments described below illustrate comprehensive or specific examples. Numeric values, configurations, materials, components, arrangement positions of the components, connection states, and manufacturing order illustrated in the following embodiments are only examples, and are not intended to limit the present disclosure. Among the components illustrated in the following embodiments, components that are not recited in the independent claims will be described as optional components.

First Embodiment

Figure 1:
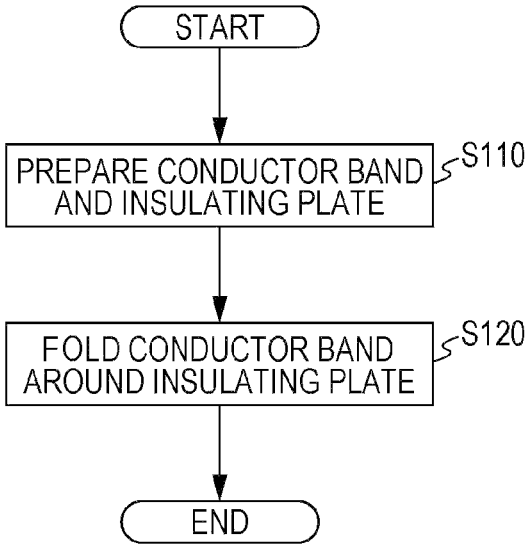
FIG. 1 is a flowchart illustrating an example of a manufacturing method for a coil structure according to a first embodiment.

FIG. 1 is a flowchart schematically illustrating an example of a manufacturing method for a coil structure. An example of the manufacturing method for a coil structure will be discussed below with reference to FIG. 1.

In step S110, at least one conductor band and at least one insulating plate are prepared.

In step S120, the conductor band is wound around the insulating plate. The insulating plate includes an edge portion used for folding the conductor band. As a result, the edge portion of the insulating plate abuts along a folded portion of the conductor band. The conductor band is repeatedly folded such that it turns around the coil axis, and as a result, it is processed into a coil.

In the conductor band, as the difference between lengths of a pair of side surfaces extending in the longitudinal direction of the conductor band is smaller, the difference between electrical lengths of portions around these side surfaces is smaller, thereby reducing resistive losses of the coil.

In the following embodiments, various folding patterns of conductor bands will be described. These folding patterns are formed by the manufacturing method indicated by the flowchart of FIG. 1. The folding patterns of conductor bands in the following embodiments are not restricted to specific folding patterns discussed below.

The configuration of an insulating plate may be determined according to the folding pattern of a conductor band. Accordingly, the insulating plates used in the following embodiments are not restricted to specific configurations discussed below.

Second Embodiment

In a second embodiment, examples of folding patterns will be discussed.

Figure 2A:
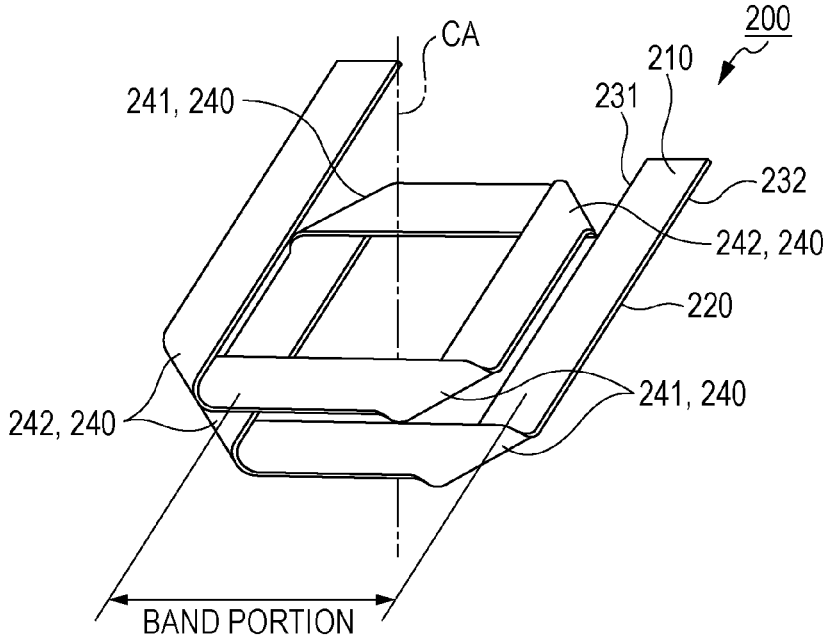
FIG. 2A is a schematic perspective view illustrating an example of a conductor band.
Figure 2B:
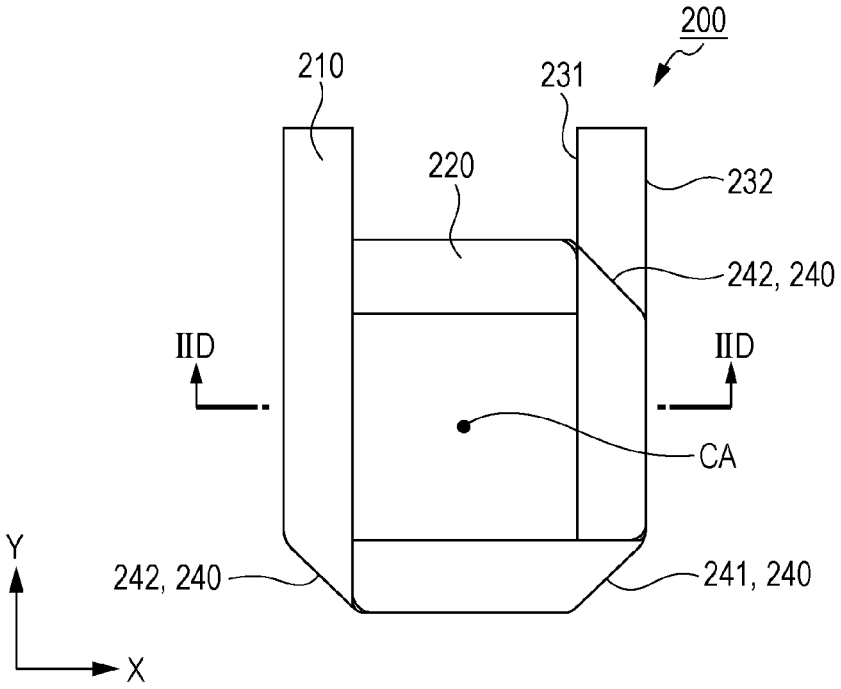
FIG. 2B is a schematic plan view of the conductor band shown in FIG. 2A.
Figure 2C:
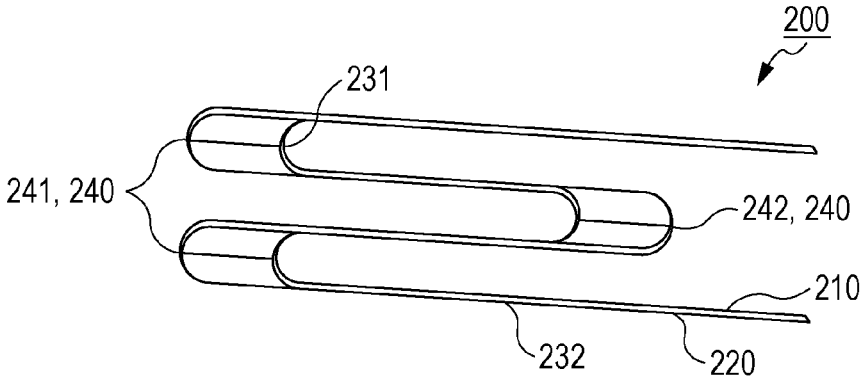
FIG. 2C is a schematic side view of the conductor band shown in FIG. 2A.
Figure 2D:
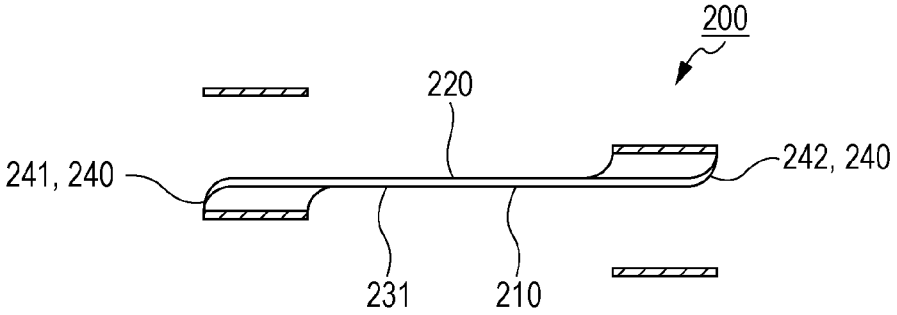
FIG. 2D is a sectional view taken along line IID-IID of FIG. 2B.

FIG. 2A is a schematic perspective view illustrating a conductor band 200 which is folded by using the manufacturing method of the first embodiment. FIG. 2B is a schematic plan view of the conductor band 200. FIG. 2C is a schematic side view of the conductor band 200. FIG. 2D is a sectional view taken along line IID-IID of FIG. 2B. The conductor band 200 will be described below with reference to FIGS. 2A through 2D.

The conductor band 200 includes a first band surface 210, a second band surface 220 which opposes the first band surface 210, and a pair of side surfaces 231 and 232 which connect the first band surface 210 and the second band surface 220. The conductor band 200 also includes a plurality of folded portions 240 formed by repeatedly folding the conductor band 200 such that it turns around the coil axis CA. The folded portions 240 include a plurality of first folded parts 241 and a plurality of second folded parts 242. At a first folded part 241, part of the first band surface 210 is folded inwardly. In other words, at a first folded part 241, two regions included in the first band surface 210 face each other. At a second folded part 242, part of the second band surface 220 is folded inwardly. In other words, at a second folded part 242, two regions included in the second band surface 220 face each other. The first folded parts 241 and the second folded parts 242 are alternately formed along the extending direction of the conductor band 200.

Figure 3B:
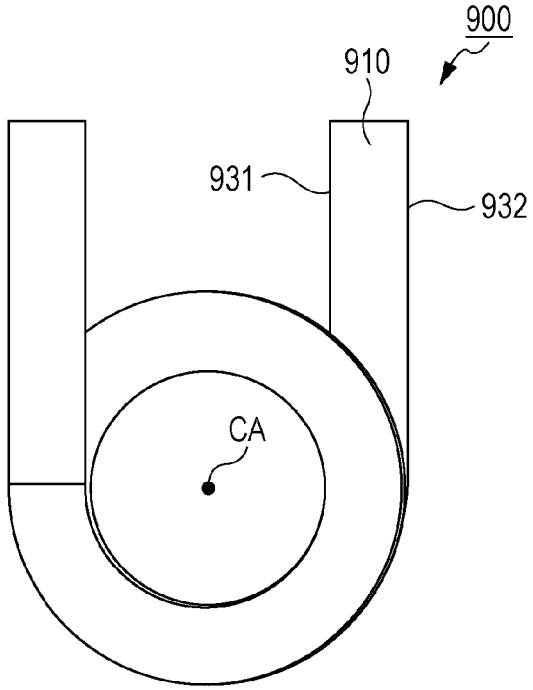
FIG. 3B is a schematic plan view illustrating the edgewise coil shown in FIG. 3A.
Figure 3C:
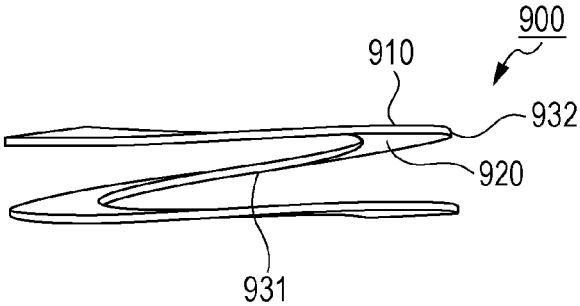
FIG. 3C is a schematic side view illustrating the edgewise coil shown in FIG. 3A.

FIG. 3A is a schematic perspective view illustrating a known edgewise coil 900. FIG. 3B is a schematic plan view illustrating the edgewise coil 900. FIG. 3C is a schematic side view illustrating the edgewise coil 900. The differences between the conductor band 200 and the edgewise coil 900 will be discussed below with reference to FIGS. 2A through 3C.

The edgewise coil 900 includes a first band surface 910, a second band surface 920 which opposes the first band surface 910, and a pair of side surfaces 931 and 932 which connect the first band surface 910 and the second band surface 920. The coil axis CA is shown in FIG. 3A, as well as in FIG. 2A. The side surface 931 turns around the coil axis CA while being constantly located near the coil axis CA. In contrast, the side surface 932 turns around the coil axis CA while being constantly located far away from the coil axis CA. Accordingly, the side surface 931 is noticeably shorter than the side surface 932.

FIG. 2B illustrates the conductor band 200 on the XY coordinates. The conductor band 200 includes sections extending in the X-axis direction and sections extending in the Y-axis direction. The sections extending in the X-axis direction and the sections extending in the Y-axis direction are alternately formed. Thus, the conductor band 200 is a rectangular coil.

In the sections extending in the X-axis direction, the side surface 231 is positioned farther away from the coil axis CA than the side surface 232. In contrast, in the sections extending in the Y-axis direction, the side surface 231 is positioned closer to the coil axis CA than the side surface 232. Accordingly, the difference between the length of the side surface 231 and that of the side surface 232 is small. As a result, it is less likely that a current flowing through the conductor band 200 will be biased toward one of the side surfaces 231 and 232. Thus, resistive losses occurring in the conductor band 200 are smaller than those of the edgewise coil 900.

Figure 4:
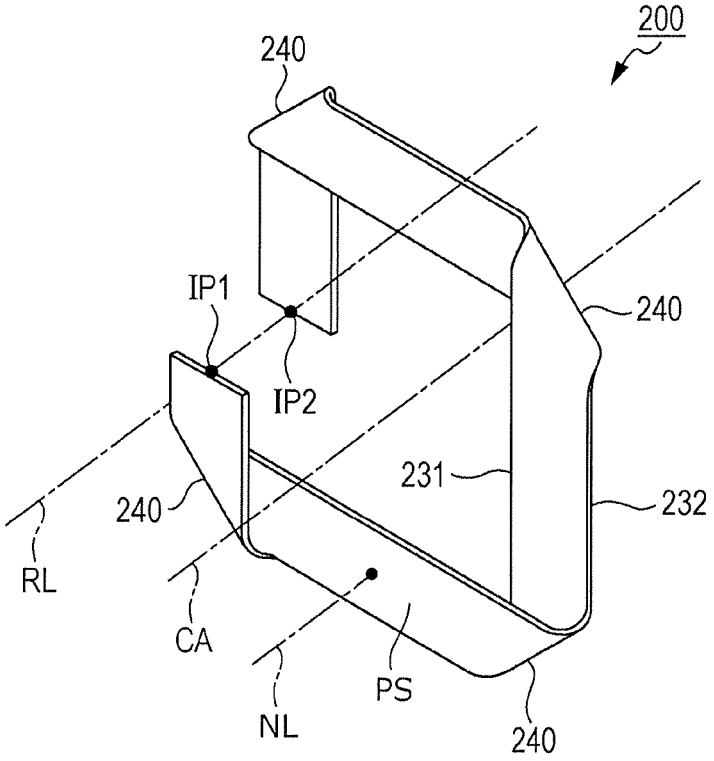
FIG. 4 is a schematic perspective view illustrating part of the conductor band shown in FIG. 2A.

FIG. 4 is a schematic perspective view illustrating part of the conductor band 200. A folding pattern of the conductor band 200 will be discussed below with reference to FIGS. 1 and 4.

The coil axis CA and a reference line RL parallel with the coil axis CA are shown in FIG. 4. Intersection points IP1 and IP2 between the reference line RL and the conductor band 200 are also shown in FIG. 4. Hereinafter, a section of the conductor band 200 from the intersection point IP1 to the intersection point IP2 will be referred to as "a turn section". A portion between the intersection points IP1 and IP2 of the conductor band 200 turns around the coil axis CA through one revolution. Typically, the conductor band 200 has a larger sectional area than litz wire, and thus, a larger current can flow through the conductor band 200. From this point of view, a coil structure may have a small number of turn sections.

FIG. 4 shows that four folded portions 240 are formed within one turn section. Accordingly, a manufacturer may prepare four insulating plates per turn section in step S110 discussed with reference to FIG. 1.

Figure 5:
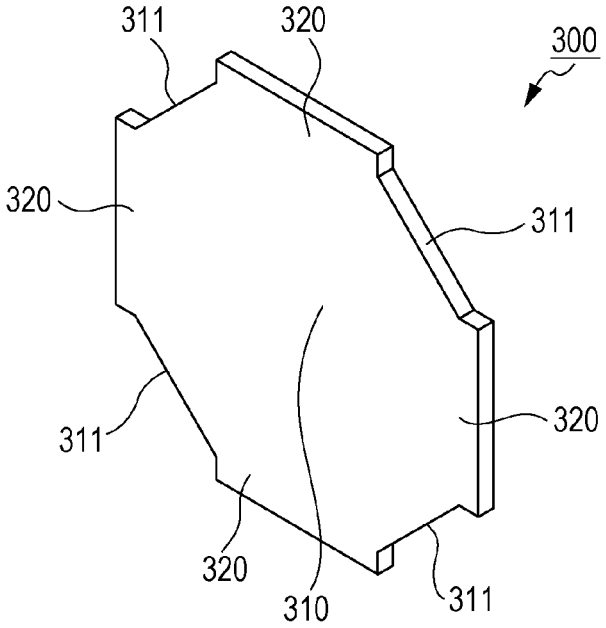
FIG. 5 is a schematic perspective view illustrating an example of an insulating plate.

FIG. 5 is a schematic perspective view illustrating an example of an insulating plate 300 used together with the conductor band 200. The insulating plate 300 will be discussed below with reference to FIGS. 4 and 5.

The insulating plate 300 includes a substantially octagonal base portion 310 and four protruding portions 320 protruding from the base portion 310. The base portion 310 includes four outer peripheral edges 311. The protruding portions 320 and the outer peripheral edges 311 are alternately arranged. One of the four outer peripheral edges 311 abuts along one of the folded portions 240 shown in FIG. 4. Accordingly, the outer peripheral edge 311 can define the folding angle of the folded portion 240. A pair of protruding portions 320, between which a folded portion 240 disposed, has surfaces opposing the side surfaces 231 and 232 of the folded portion 240. Accordingly, the protruding portions 320 can stably maintain the positions of the folded portions 240. One of the outer peripheral edges 311 is an example of "a first edge portion" of the present disclosure.

Figure 6:
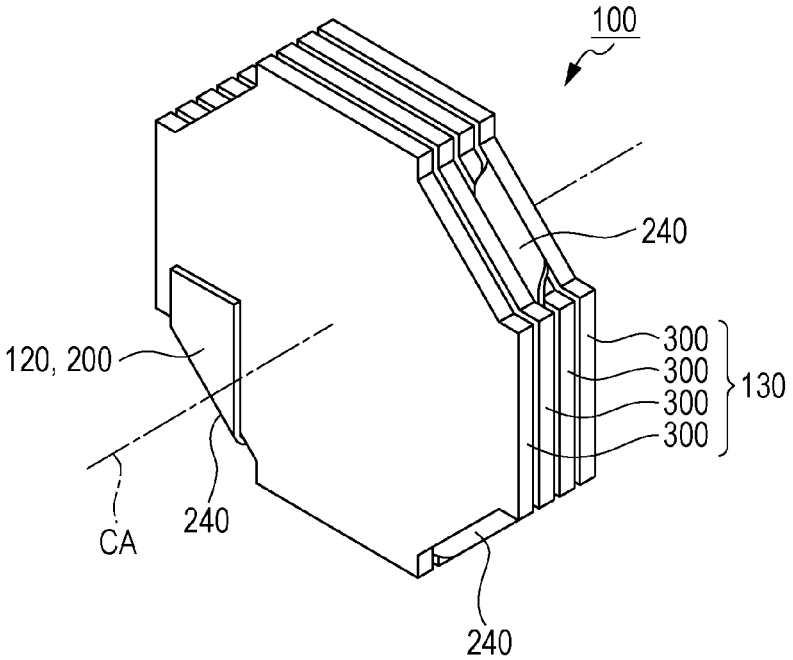
FIG. 6 is a schematic perspective view illustrating an example of a coil structure according to a second embodiment.

FIG. 6 is a schematic perspective view illustrating an example of a coil structure 100. The coil structure 100 will be described below with reference to FIGS. 4 and 6.

The coil structure 100 includes a coil 120 and an insulating plate structure 130. The coil 120 may be the conductor band 200 discussed with reference to FIG. 4. The insulating plate structure 130 may be an insulating plate array including four insulating plates 300 aligned along the coil axis CA. One insulating plate 300 is disposed such that it is assigned to a folded portion 240. With this structure, even if a compressive force in the direction of the coil axis CA is applied to the coil structure 100, it is less likely that some regions of the conductor band 200 will be in contact with each other.

Third Embodiment

The coil structure 100 of the second embodiment includes one turn section. Alternatively, the coil of the coil structure may include a plurality of turn sections. A designer designing a coil structure may determine the number of turn sections to be included in the coil structure by considering the performance demanded for the coil structure. In a third embodiment, a coil structure including two turn sections will be discussed.

Figure 7:
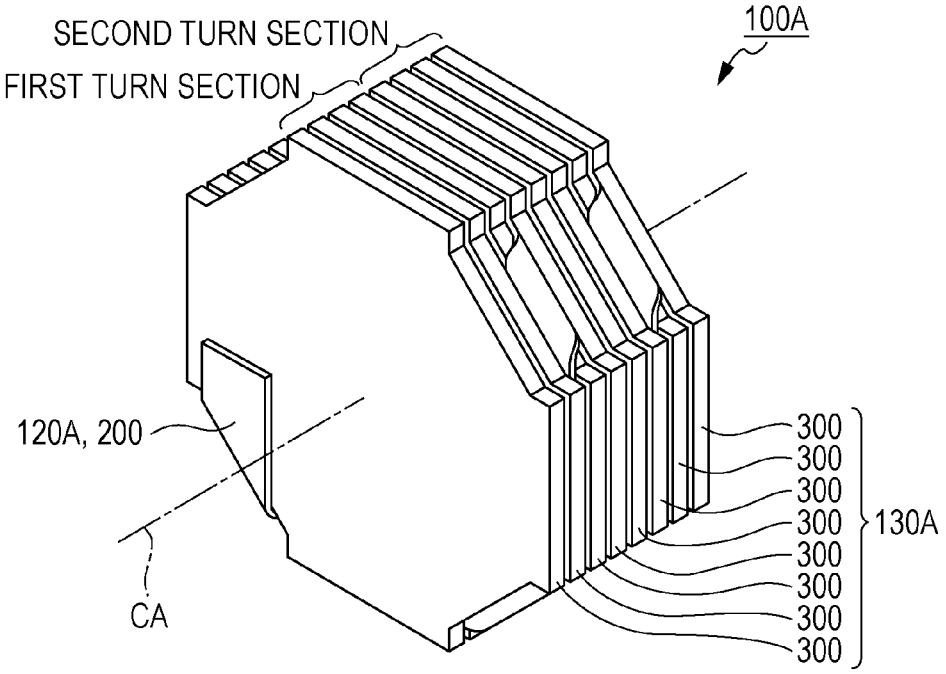
FIG. 7 is a schematic perspective view illustrating an example of a coil structure according to a third embodiment.

FIG. 7 is a schematic perspective view illustrating a coil structure 100A of the third embodiment. The coil structure 100A will be described below with reference to FIG. 7. Elements having the same functions as those of the second embodiment are designated by like reference numerals, and thus, an explanation thereof will be omitted.

The coil structure 100A includes a coil 120A and an insulating plate structure 130A. The coil 120A may be the conductor band 200 discussed in the second embodiment. The conductor band 200 includes two turn sections. In the following description, one of the two turn sections will be referred to as "a first turn section", and the other one of the two turn sections will be referred to as "a second turn section". The first turn section of the conductor band 200 turns around the coil axis CA through one revolution. The second turn section is connected to the first turn section. The second turn section of the conductor band 200 also turns around the coil axis CA through one revolution.

The insulating plate structure 130A may be an insulating plate array constituted by eight insulating plates 300 aligned along the coil axis CA. Four insulating plates 300 are assigned to the first turn section, while the remaining four insulating plates 300 are assigned to the second turn section.

In the present disclosure, a plurality of insulating plates assigned to the first turn section may be referred to as "a first plurality of insulating plates", and a plurality of insulating plates assigned to the second turn section may be referred to as "a second plurality of insulating plates". In the example shown in FIG. 7, a group of the first plurality of insulating plates and a group of the second plurality of insulating plates each constituted by four insulating plates 300. The first plurality of insulating plates may include, for example, a first insulating plate. In the present disclosure, folded portions included in the first turn section may be referred to as "first folded portions", and folded portions included in the second turn section may be referred to as "second folded portions".

Fourth Embodiment

A coil structure may include a magnetic core extending along the coil axis. Due to the provision of a magnetic core, high inductance can be exhibited. In a fourth embodiment, a coil structure including a magnetic core will be discussed.

Figure 8:
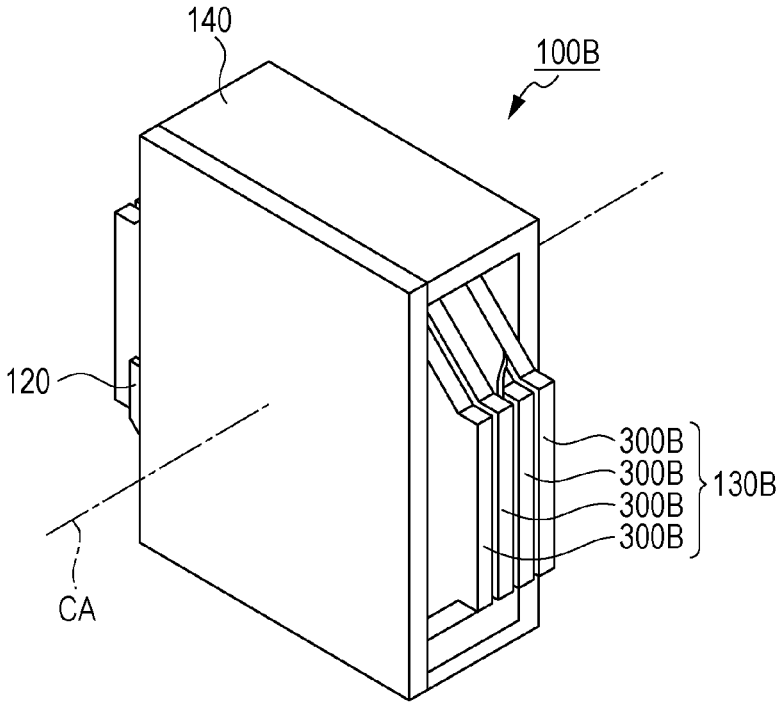
FIG. 8 is a schematic perspective view illustrating an example of a coil structure according to a fourth embodiment.

FIG. 8 is a schematic perspective view illustrating a coil structure 100B of the fourth embodiment. The coil structure 100B will be described below with reference to FIG. 8. Elements having the same functions as those of the second embodiment are designated by like reference numerals, and thus, an explanation thereof will be omitted.

As in the second embodiment, the coil structure 100B includes a coil 120. The coil structure 100B also includes an insulating plate structure 130B and a magnetic casing 140. The insulating plate structure 130B includes a plurality of insulating plates 300B. The arrangement of the plurality of insulating plates 300B with respect to the coil 120 is similar to that of the second embodiment.

Figure 9:
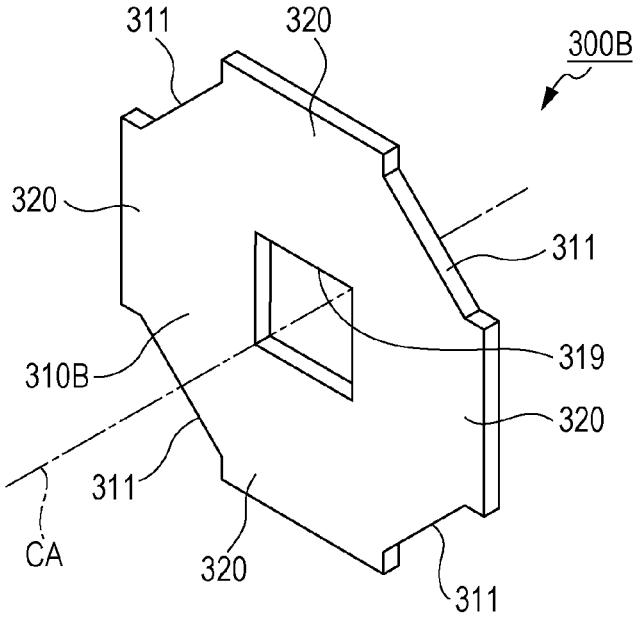
FIG. 9 is a schematic perspective view illustrating an example of an insulating plate included in the coil structure shown in FIG. 8.

FIG. 9 is a schematic perspective view illustrating an example of the insulating plate 300B. The insulating plate 300B will be discussed below with reference to FIG. 9.

As in the second embodiment, the insulating plate 300B includes four protruding portions 320. The insulating plate 300B also includes a substantially octagonal base portion 310B. As in the second embodiment, the base portion 310B includes four outer peripheral edges 311. In the base portion 310B, an axial hole 319 is formed. The center of the axial hole 319 substantially coincides with the coil axis CA. In FIG. 9, the axial hole 319 is substantially a square.

Figure 10C:
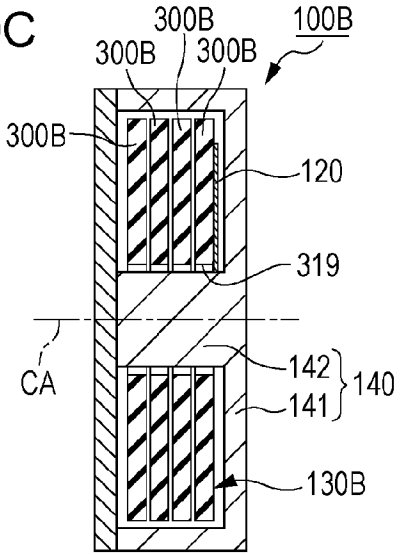
FIG. 10C is a schematic sectional view of the coil structure taken along line XC-XC of FIG. 10A.
Figure 10A:
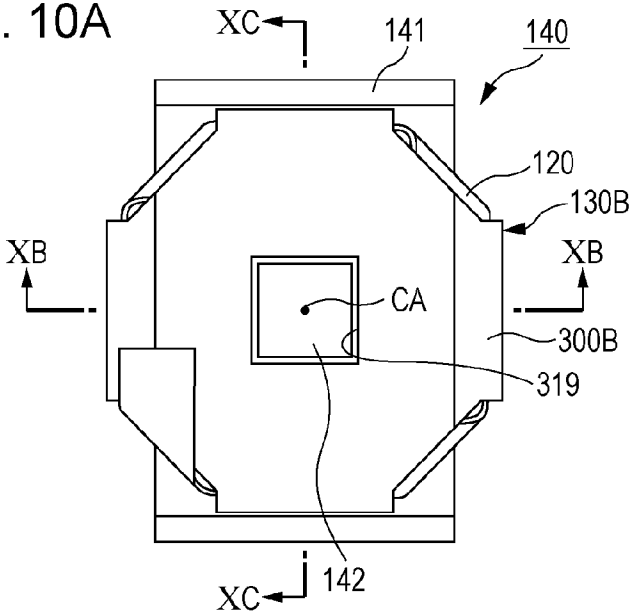
FIG. 10A is a schematic sectional view illustrating a magnetic casing included in the coil structure shown in FIG. 8.
Figure 10B:
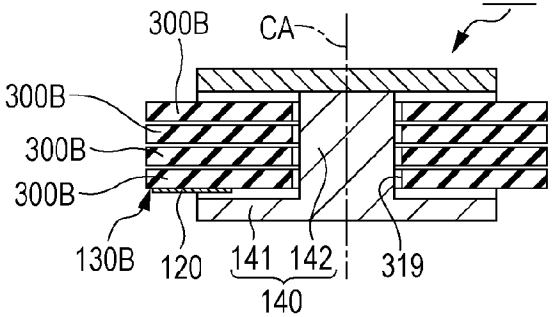
FIG. 10B is a schematic sectional view of the coil structure taken along line XB-XB of FIG. 10A.

FIG. 10A is a schematic sectional view illustrating the magnetic casing 140. FIG. 10B is a schematic sectional view of the coil structure 100B taken along line XB-XB of FIG. 10A. FIG. 10C is a schematic sectional view of the coil structure 100B taken along line XC-XC of FIG. 10A. The magnetic casing 140 will be discussed below with reference to FIGS. 10A through 10C.

As in the second embodiment, the plurality of insulating plates 300B are aligned along the coil axis CA. As a result, the axial hole 319 also extends along the coil axis CA.

In the present disclosure, if a first insulating plate included in a plurality of insulating plates has an axial hole, this axial hole may be referred to as "a first axial hole", and if a second insulating plate included in a plurality of insulating plates has an axial hole, this axial hole may be referred to as "a second axial hole".

The magnetic casing 140 includes an outer wall portion 141 and a magnetic core 142. The outer wall portion 141 surrounds the insulating plate structure 130B having the coil 120 fixed thereto. The magnetic core 142 passes through the axial hole 319 along the coil axis CA. The configuration of the magnetic core 142 is complementary to the configuration of the axial hole 319. Accordingly, the coil 120 and the insulating plate structure 130B do not unnecessarily rotate around the magnetic core 142. That is, the magnetic core 142 can define the angles of the coil 120 and the insulating plate structure 130B so as to position them.

The configuration of the axial hole 319 and the configuration of the magnetic core 142 are not restricted to those discussed above. As long as the configurations of the axial hole 319 and the magnetic core 142 are noncircular and are complementary to each other, the magnetic core 142 can suitably position the insulating plate structure 130B having the coil 120 fixed thereto.

Fifth Embodiment

In the coil structures 100, 100A, and 100B of the second, third, and fourth embodiments, respectively, the outer peripheral edges 311 are used for folding a conductor band. Accordingly, the coil structures 100, 100A, and 100B can be formed by using a simple manufacturing method. In a fifth embodiment, a manufacturing method for a coil structure will be described.

FIGS. 11A through 11H are schematic views illustrating steps for folding the conductor band 200 by using insulating plates. An example of the manufacturing method for the coil structure 100B will be described below with reference to FIGS. 1, 2A, 9, and 11A through 11H. Elements having the same functions as those of the fourth embodiment are designated by like reference numerals, and thus, an explanation thereof will be omitted.

In step S110 of FIG. 1, a manufacturer prepares a conductor band 200 and insulating plates 301 through 304. Each of the insulating plates 301 through 304 corresponds to the insulating plate 300B discussed with reference to FIG. 9.

Each of the insulating plates 301 through 304 includes edge portions 312 through 315. The edge portions 312 through 315 correspond to the four outer peripheral portion edges 311 discussed with reference to FIG. 9. In FIGS. 11A through 11H, the edge portion 312 is positioned at the top left as viewed from the coil axis CA, the edge portion 313 is positioned at the top right as viewed from the coil axis CA, the edge portion 314 is positioned at the bottom right as viewed from the coil axis CA, and the edge portion 315 is positioned at the bottom left as viewed from the coil axis CA. Each of the edge portions 312 through 315 form part of the contour of each of the insulating plates 301 through 304. For example, if the insulating plate 301 has a pair of opposing principal surfaces, the edge portion 312 is part of a side surface connecting the contours of the pair of principal surfaces.

FIGS. 11A through 11H show XY coordinates. Each of the edge portions 312 through 315 is tilted at +45° or −45° with respect to the X axis. The conductor band 200 is sequentially folded along the edge portions 312 through 315. In the process in which the conductor band 200 is being folded, the conductor band 200 is constituted by a portion extending in the X-axis direction and a portion extending in the Y-axis direction. In the present disclosure, portions of a conductor band other than folded portions may be referred to as "band portions" or "remaining portions".

The conductor band 200 includes a start portion 201 and an end portion 202 opposite to the start portion 201. The conductor band 200 has one turn section between the start portion 201 and the end portion 202.

Figure 11A:
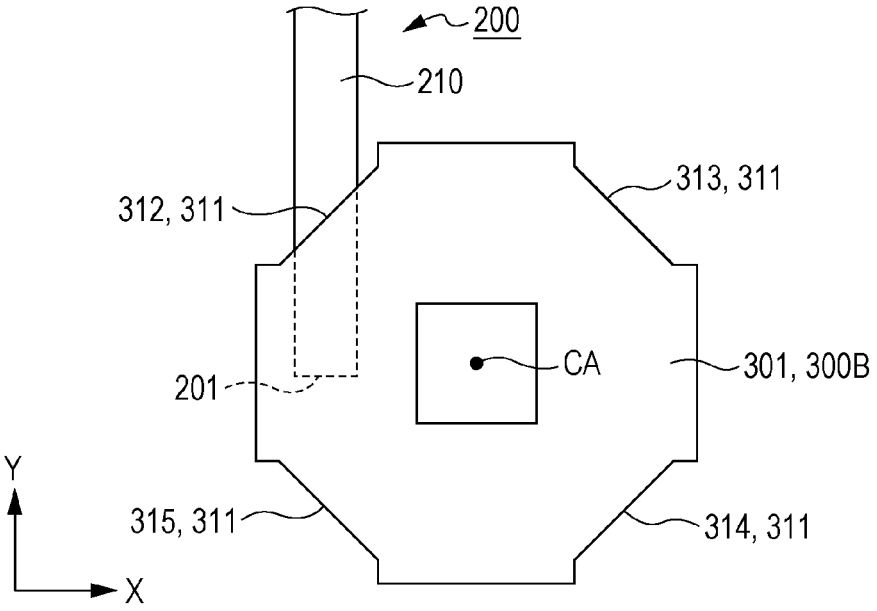
FIGS. 11A through 11H are schematic views illustrating examples of steps for folding a conductor band.
Figure 11B:
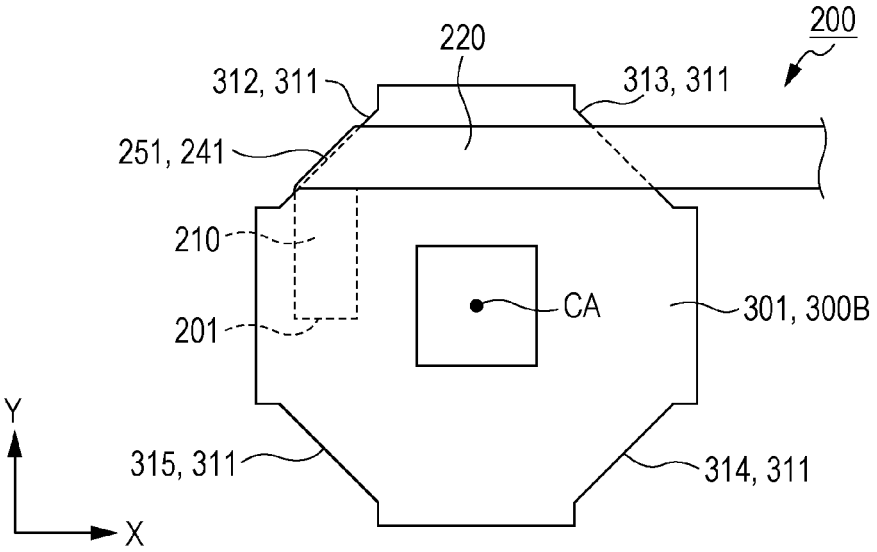

The first band surface 210 of the conductor band 200 extending in the Y-axis positive direction is shown in FIG. 11A. As shown in FIG. 11A, a manufacturer superposes the insulating plate 301 on the start portion 201. Then, as shown in FIG. 11B, the manufacturer folds the conductor band 200 along the edge portion 312 so as to form a folded portion 251. As a result, around the edge portion 312, a section of the first band surface 210 in a range from the start portion 201 to the edge portion 312 faces the remaining section of the first band surface 210. On the other hand, as shown in FIG. 11B, the second band surface 220 appears on the insulating plate 301 such that it extends from the edge portion 312 in the X-axis positive direction. The folded portion 251 corresponds to the first folded part 241 discussed with reference to FIG. 2A.

In FIG. 11A, a portion in which the insulating plate 301 and the conductor band 200 are superposed is an example of "a first band portion" in the fifth embodiment. In FIG. 11B, a portion of the conductor band 200 positioned in front of the insulating plate 301 is an example of "a first remaining portion" in the fifth embodiment. The insulating plate 301 in FIGS. 11A and 11B is an example of "a first insulating plate" of the fifth embodiment.

Figure 11C:
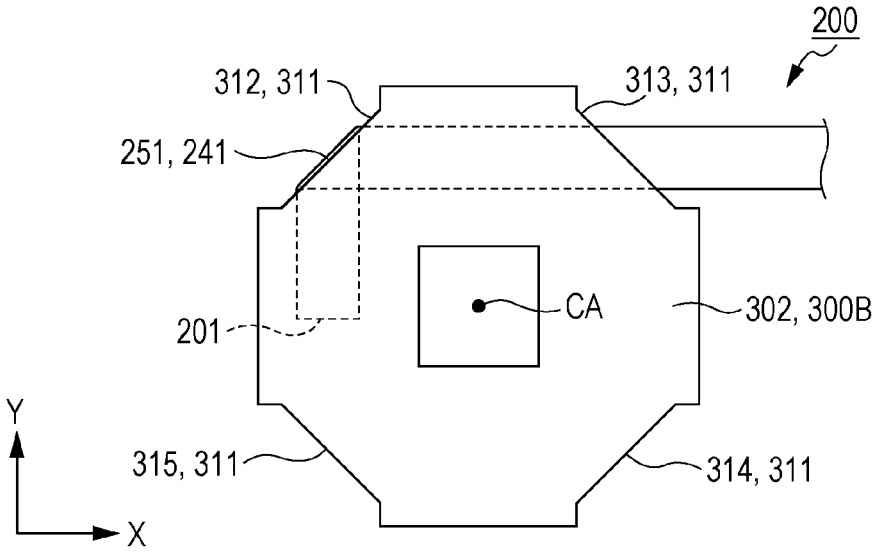
Figure 11D:
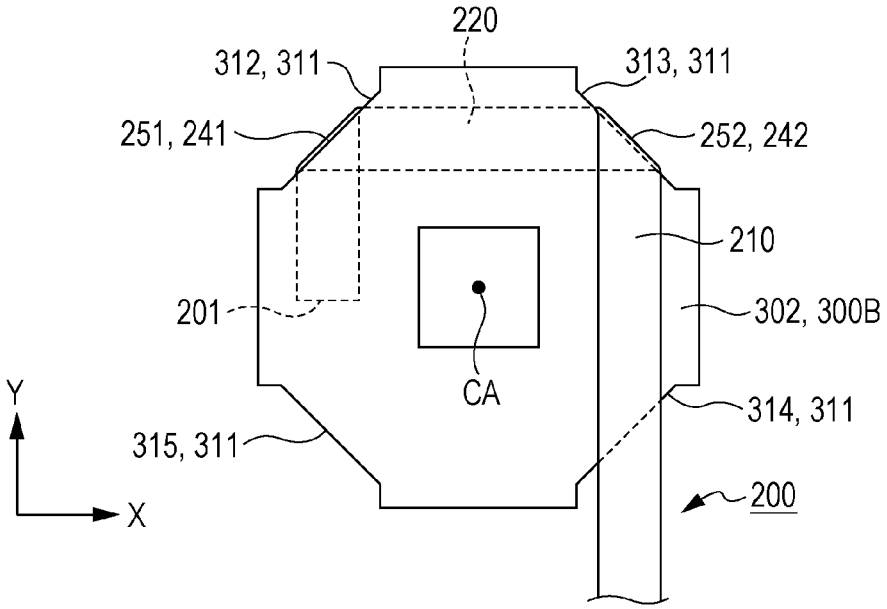

After forming the folded portion 251, as shown in FIG. 11C, the manufacturer superposes the insulating plate 302 on the insulating plate 301. As a result, a portion of the conductor band 200 between the edge portions 312 and 313 is sandwiched between the insulating plates 301 and 302. Then, as shown in FIG. 11D, the manufacturer folds the conductor band 200 along the edge portion 313 so as to form a folded portion 252. As a result, around the folded portion 252, a section of the second band surface 220 positioned between the edge portions 312 and 313 faces the subsequent section of the second band surface 220. On the other hand, as shown in FIG. 11D, the first band surface 210 appears on the insulating plate 302 such that it extends from the edge portion 313 in the Y-axis negative direction. The folded portion 252 corresponds to the second folded part 242 discussed with reference to FIG. 2A.

In FIG. 11C, a portion of the conductor band 200 sandwiched between the insulating plates 301 and 302 is an example of "a second band portion" in the fifth embodiment. In FIG. 11D, a portion of the conductor band 200 positioned in front of the insulating plate 302 is an example of "a second remaining portion" in the fifth embodiment. The insulating plate 302 in FIGS. 11C and 11D is an example of "a second insulating plate" of the fifth embodiment.

Figure 11E:
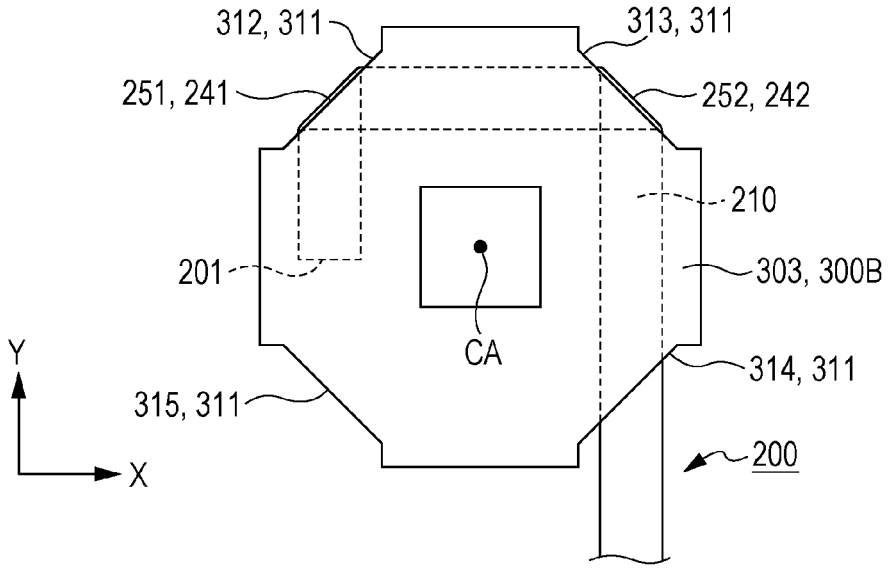
Figure 11F:
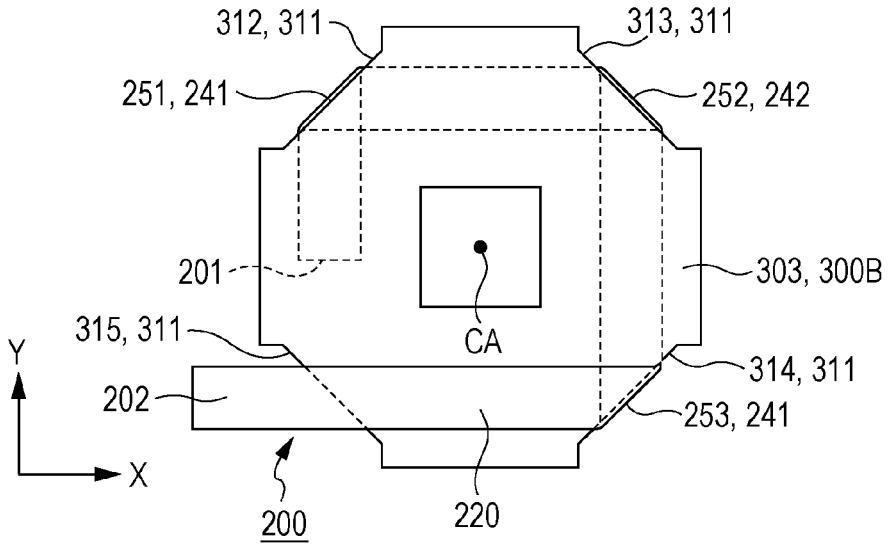

After forming the folded portion 252, as shown in FIG. 11E, the manufacturer superposes the insulating plate 303 on the insulating plate 302. As a result, a portion of the conductor band 200 between the edge portions 313 and 314 is sandwiched between the insulating plates 302 and 303. Then, as shown in FIG. 11F, the manufacturer folds the conductor band 200 along the edge portion 314 so as to form a folded portion 253. As a result, around the folded portion 253, a section of the first band surface 210 positioned between the edge portions 313 and 314 faces the subsequent section of the first band surface 210. On the other hand, as shown in FIG. 11F, the second band surface 220 appears on the insulating plate 303 such that it extends from the edge portion 314 in the X-axis negative direction. The folded portion 253 corresponds to the first folded part 241 discussed with reference to FIG. 2A.

In FIG. 11E, a portion of the conductor band 200 sandwiched between the insulating plates 302 and 303 is an example of "a third band portion" in the fifth embodiment. In FIG. 11F, a portion of the conductor band 200 positioned in front of the insulating plate 303 is an example of "a third remaining portion" in the fifth embodiment. The insulating plate 303 in FIGS. 11E and 11F is an example of "a third insulating plate" of the fifth embodiment.

Figure 11G:
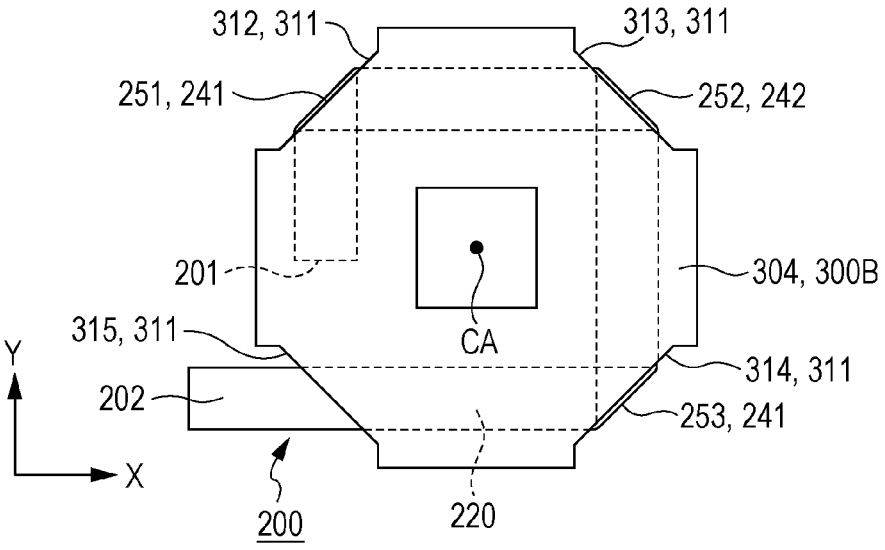
Figure 11H:
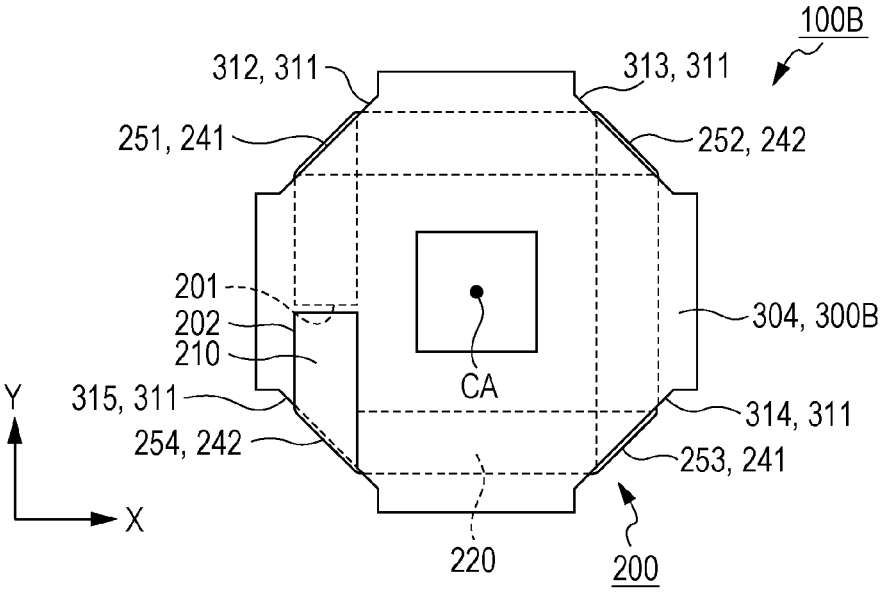

After forming the folded portion 253, as shown in FIG. 11G, the manufacturer superposes the insulating plate 304 on the insulating plate 303. As a result, a portion of the conductor band 200 between the edge portions 314 and 315 is sandwiched between the insulating plates 303 and 304. Then, as shown in FIG. 11H, the manufacturer folds the conductor band 200 along the edge portion 315 so as to form a folded portion 254. As a result, around the folded portion 254, a section of the second band surface 220 formed between the edge portions 314 and 315 faces a section of the second band surface 220 in a range from the edge portion 315 to the end portion 202. On the other hand, as shown in FIG. 11H, the first band surface 210 appears on the insulating plate 304 such that it extends from the edge portion 315 to the end portion 202 in the Y-axis positive direction. The folded portion 254 corresponds to the second folded part 242 discussed with reference to FIG. 2A.

In FIG. 11G, a portion of the conductor band 200 sandwiched between the insulating plates 303 and 304 is an example of "a fourth band portion" in the fifth embodiment. In FIG. 11H, a portion of the conductor band 200 positioned in front of the insulating plate 304 is an example of "a fourth remaining portion" or "a fifth band portion" in the fifth embodiment. The insulating plate 304 in FIGS. 11G and 11H is an example of "a fourth insulating plate" of the fifth embodiment.

Sixth Embodiment

In the fifth embodiment, four insulating plates are used for forming one turn section. Alternatively, a single insulating plate may be used for forming one turn section. In a sixth embodiment, a manufacturing method for a coil structure by forming a turn section by using a single insulating plate will be discussed.

FIGS. 12A through 12E are schematic views illustrating steps for folding a conductor band 200 by using an insulating plate 301. An example of the manufacturing method for a coil structure 100C will be discussed below with reference to FIGS. 1 and 12A through 12E. Elements having the same functions as those of the fifth embodiment are designated by like reference numerals, and thus, an explanation thereof will be omitted.

In step S110 of FIG. 1, a manufacturer prepares a conductor band 200 and an insulating plate 301.

FIGS. 12A through 12E show XY coordinates. The conductor band 200 is sequentially folded along edge portions 312 through 315 of the insulating plate 301. In the process in which the conductor band 200 is being folded, the conductor band 200 is constituted by a portion extending in the X-axis direction and a portion extending in the Y-axis direction.

Figure 12A:
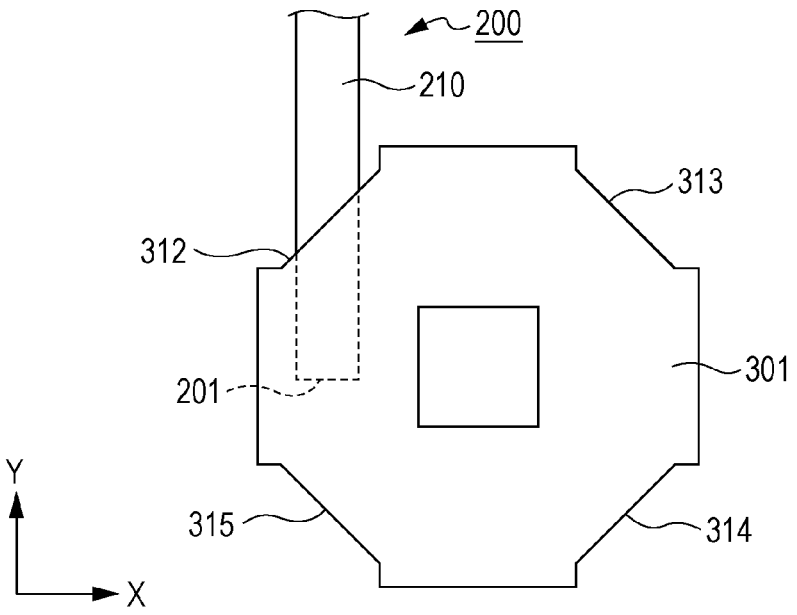
FIGS. 12A through 12E are schematic views illustrating examples of steps for folding a conductor band.
Figure 12B:
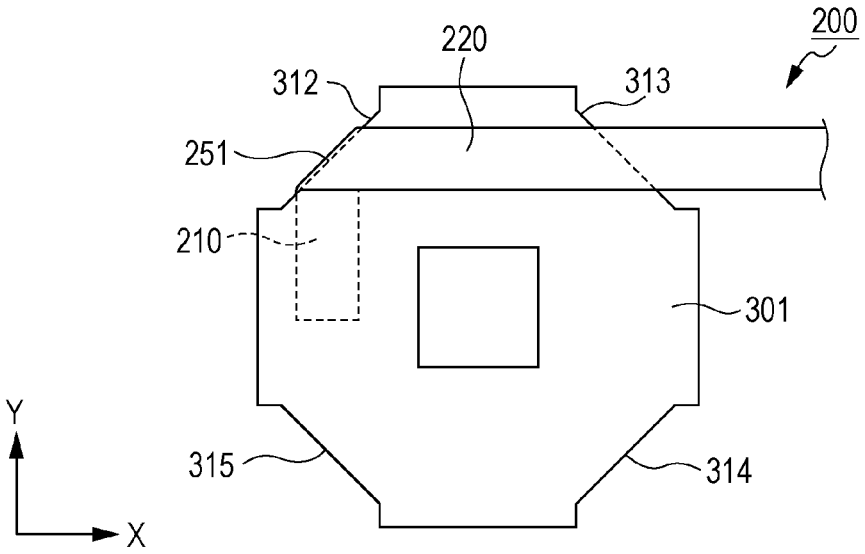

The first band surface 210 of the conductor band 200 extending in the Y-axis positive direction is shown in FIG. 12A. As shown in FIG. 12A, a manufacturer superposes the insulating plate 301 on a start portion 201 of the conductor band 200. Then, as shown in FIG. 12B, the manufacturer folds the conductor band 200 along the edge portion 312 so as to form a folded portion 251. As a result, around the edge portion 312, a section of the first band surface 210 in a range from the start portion 201 to the edge portion 312 faces the remaining section of the first band surface 210. On the other hand, as shown in FIG. 12B, the second band surface 220 appears on the insulating plate 301 such that it extends from the edge portion 312 in the X-axis positive direction.

In FIG. 12A, a portion in which the insulating plate 301 and the conductor band 200 are superposed is an example of "a first band portion" in the sixth embodiment. In FIG. 12B, a portion of the conductor band 200 positioned in front of the insulating plate 301 is an example of "a first remaining portion" in the sixth embodiment.

Figure 12C:
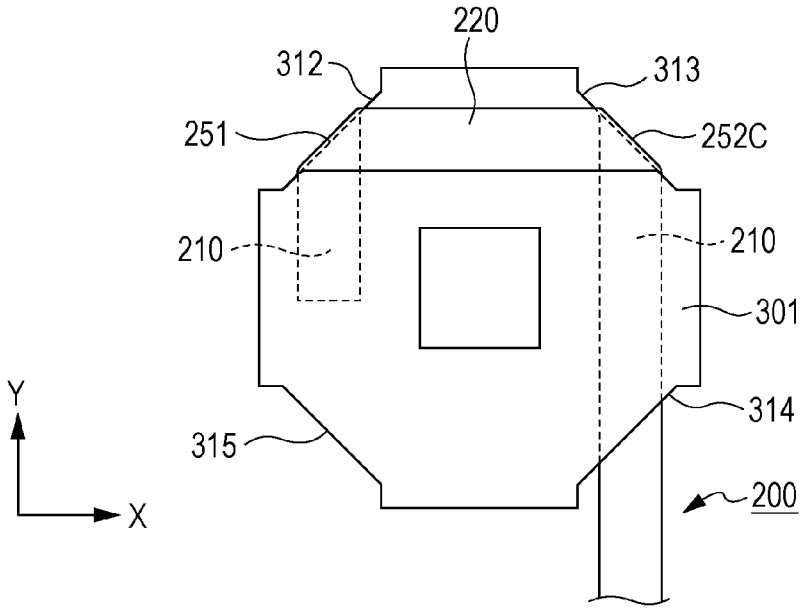

After forming the folded portion 251, as shown in FIG. 12C, the manufacturer folds the conductor band 200 along the edge portion 313 so as to form a folded portion 252C. As a result, around the folded portion 252C, a section of the first band surface 210 positioned between the edge portions 312 and 313 faces the subsequent section of the first band surface 210. In FIG. 12C, the first band surface 210 appears behind the insulating plate 301 such that it extends from the edge portion 313 in the Y-axis negative direction.

In FIG. 12C, a portion of the conductor band 200 positioned in front of the insulating plate 301 is an example of "a second band portion" in the sixth embodiment. In FIG. 12C, a portion of the conductor band 200 positioned behind the insulating plate 301 and extending from the folded portion 252C is an example of "a second remaining portion" in the sixth embodiment.

Figure 12D:
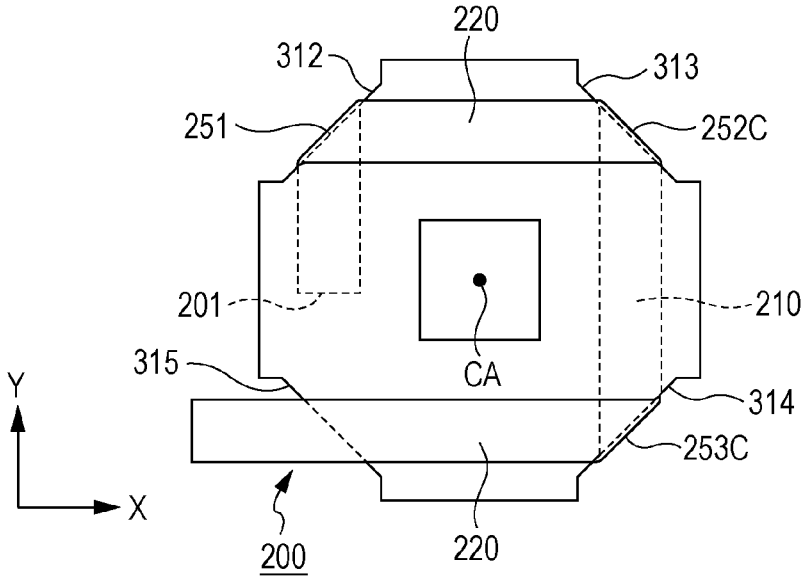

After forming the folded portion 252C, as shown in FIG. 12D, the manufacturer folds the conductor band 200 along the edge portion 314 so as to form a folded portion 253C. As a result, around the folded portion 253C, a section of the first band surface 210 formed between the edge portions 313 and 314 faces the subsequent section of the first band surface 210. In FIG. 12D, the second band surface 220 appears on the insulating plate 301 such that it extends from the edge portion 314 in the X-axis negative direction.

In FIG. 12D, a portion of the conductor band 200 positioned behind the insulating plate 301 and extending between the folded portions 252C and 253C is an example of "a third band portion" in the sixth embodiment. In FIG. 12D, a portion of the conductor band 200 positioned in front of the insulating plate 301 and extending from the folded portion 253C in the X-axis negative direction is an example of "a third remaining portion" in the sixth embodiment.

Figure 12E:
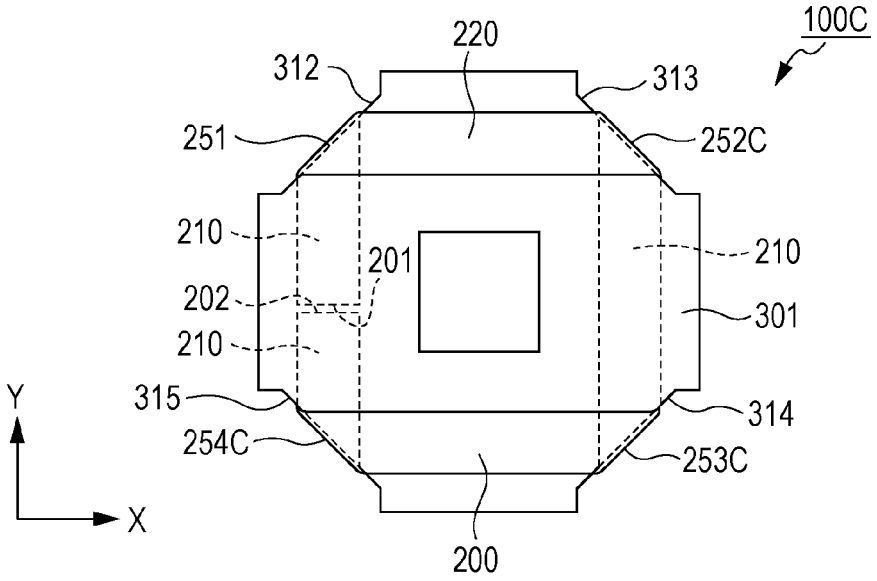

After forming the folded portion 253C, as shown in FIG. 12E, the manufacturer folds the conductor band 200 along the edge portion 315 so as to form a folded portion 254C. As a result, around the folded portion 254C, a section of the first band surface 210 positioned between the edge portions 314 and 315 faces a section of the first band surface 210 in a range from the edge portion 315 to the end portion 202. The end portion 202 is located close to the start portion 201. As a result of folding the conductor band 200, one turn section is formed. In this manner, the coil structure 100C including one turn section is formed.

In FIG. 12E, a portion of the conductor band 200 positioned in front of the insulating plate 301 and extending between the folded portions 253C and 254C is an example of "a fourth band portion" in the sixth embodiment. In FIG. 12E, a portion of the conductor band 200 positioned behind the insulating plate 301 and extending from the folded portion 254C is an example of "a fourth remaining portion" or "a fifth band portion" in the sixth embodiment. In FIG. 12E, the folded portions 251, 252C, 253C, and 254C are examples of "a plurality of folded parts" in the sixth embodiment. At each of the folded portions 251, 252C, 253C, and 254C, part of the first band surface 210 is folded inwardly.

The coil structure 100C may be used singly. Alternatively, the manufacturer may repeat the folding steps shown in FIGS. 12A through 12E so as to prepare a plurality of coil structures 100C. The manufacturer may align the plurality of coil structures 100C and may also interpose an insulating member between the coil structures 100C.

Seventh Embodiment

A coil structure is applicable to various devices. If a device into which a coil structure is integrated is designed to be small, the coil structure may be disposed near another component within the device. In this case, in terms of the safety and the reliability of the device, a long creepage distance may be required between the coil structure and another component. In a seventh embodiment, an insulating plate which makes it possible to provide a long creepage distance between a coil structure and another component will be discussed. The insulating plate in the seventh embodiment may be used instead of the insulating plates used in the second through fourth embodiments.

Figure 13A:
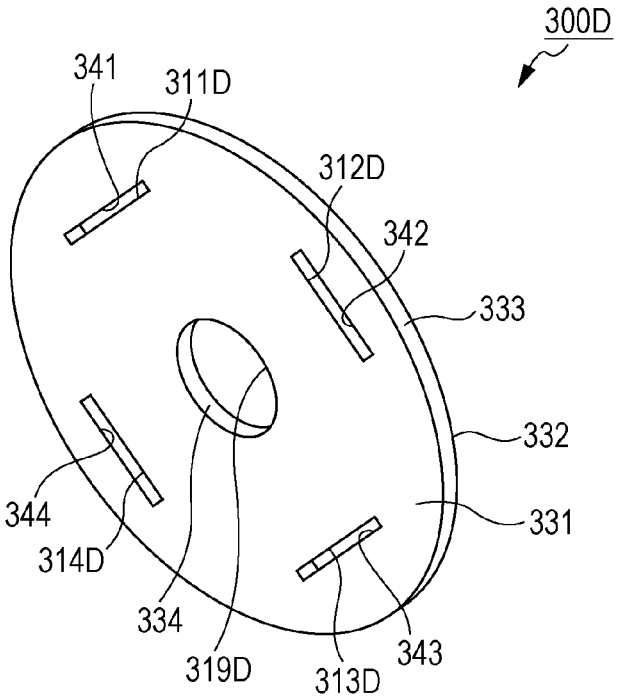
FIG. 13A is a schematic perspective view illustrating an example of an insulating plate.
Figure 13B:
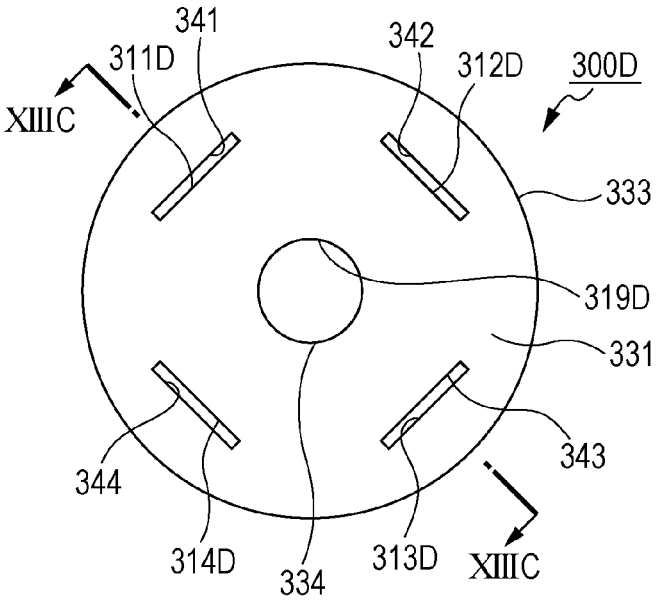
FIG. 13B is a schematic plan view illustrating the insulating plate shown in FIG. 13A.
Figure 13C:
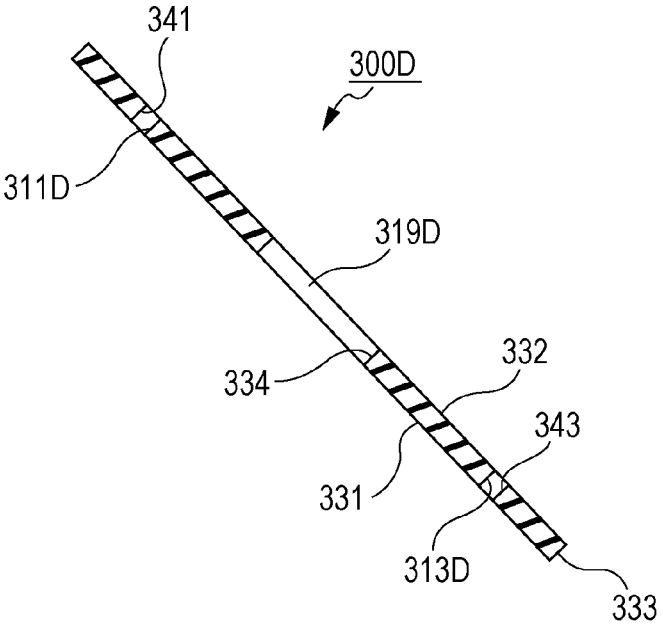
FIG. 13C is a schematic sectional view taken along line XIIIC-XIIIC of FIG. 13B.

FIG. 13A is a schematic perspective view illustrating an example of an insulating plate 300D. FIG. 13B is a schematic plan view illustrating the insulating plate 300D. FIG. 13C is a schematic sectional view taken along line XIIIC-XIIIC of FIG. 13B. The insulating plate 300D will be discussed below with reference to FIGS. 2A and 13A through 13C.

The insulating plate 300D includes a first surface 331, a second surface 332 opposite the first surface 331, an outer periphery 333 which connects an outer contour of the first surface 331 and an outer contour of the second surface 332, and an inner periphery 334 which defines an axial hole 319D coaxial with the outer periphery 333. In the seventh embodiment, the outer periphery 333, which defines a contour of the insulating plate 300D, and the axial hole 319D are, for example, circular. However, the insulating plate 300D and the axial hole 319D may be formed in another shape. The contour of the insulating plate 300D and the axial hole 319D are not restricted to a circular shape.

In the insulating plate 300D, first through fourth through-holes 341 through 344 are formed. The first through fourth through-holes 341 through 344 are disposed around the axial hole 319D at substantially regular intervals.

If the folding pattern of the conductor band 200 discussed with reference to FIG. 2A is used, the conductor band 200 passes through one of the first through fourth through-holes 341 through 344. If the folding pattern discussed in the sixth embodiment is used, the conductor band 200 sequentially passes through the first through fourth through-holes 341 through 344. In the present disclosure, one of the first through fourth through-holes 341 through 344 is an example of a "through-hole" of the present disclosure.

In the example shown in FIGS. 13A and 13B, the insulating plate 300D has four through-holes. However, the number, configuration, and arrangement of the through-holes may be determined suitably in accordance with the folding pattern of the conductor band 200. The number, configuration, and arrangement of the through-holes are not restricted.

The insulating plate 300D includes edge portions 311D through 314D used for folding the conductor band 200. The edge portions 311D through 314D partially form the contours of the first through fourth through-holes 341 through 344, respectively.

In other words, the edge portion 311D is part of the inner peripheral surface which defines the first through-hole 341, the edge portion 312D is part of the inner peripheral surface which defines the second through-hole 342, the edge portion 313D is part of the inner peripheral surface which defines the third through-hole 343, and the edge portion 314D is part of the inner peripheral surface which defines the fourth through-hole 344.

An outer area of the insulating plate 300D, positioned farther away from the coil axis CA than the first through fourth through-holes 341 through 344, can contribute to increasing the creepage distance between a coil structure and another component disposed close to the coil structure.

Eighth Embodiment

If a coil structure is formed by winding a conductor band around a plurality of insulating plates, the conductor band passes through a pair of insulating plates. Accordingly, these insulating plates are separated from each other by the thickness of the conductor band, thereby increasing the dimension of the coil structure in a direction along the coil axis. In an eighth embodiment, an insulating plate which makes it possible to reduce the dimension of a coil structure in a direction along the coil axis will be discussed. The insulating plate in the eighth embodiment may be used instead of the various insulating plates discussed in the above-described embodiments.

Figure 14A:
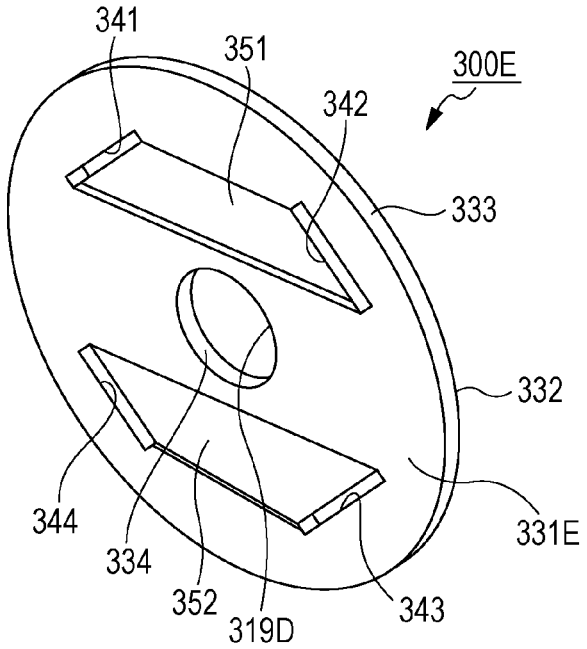
FIG. 14A is a schematic perspective view illustrating an example of an insulating plate.
Figure 14B:
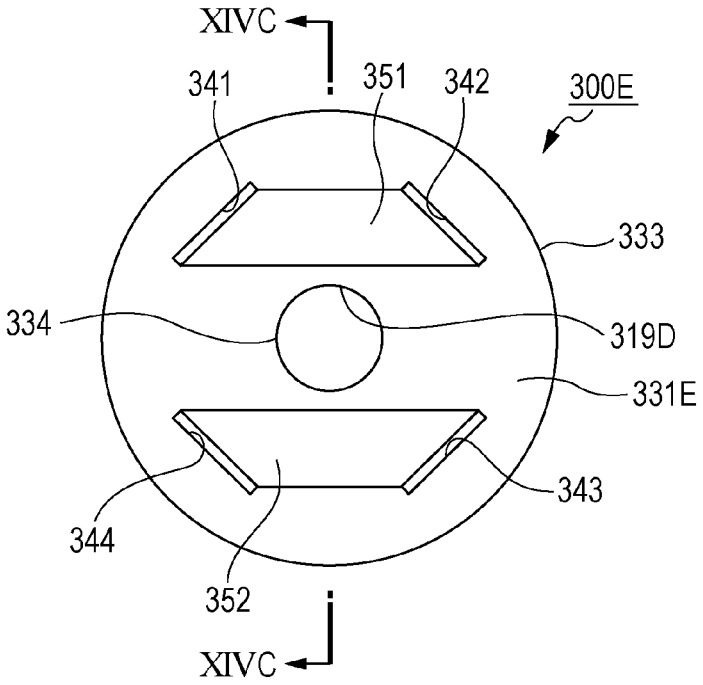
FIG. 14B is a schematic plan view illustrating the insulating plate shown in FIG. 14A.
Figure 14C:
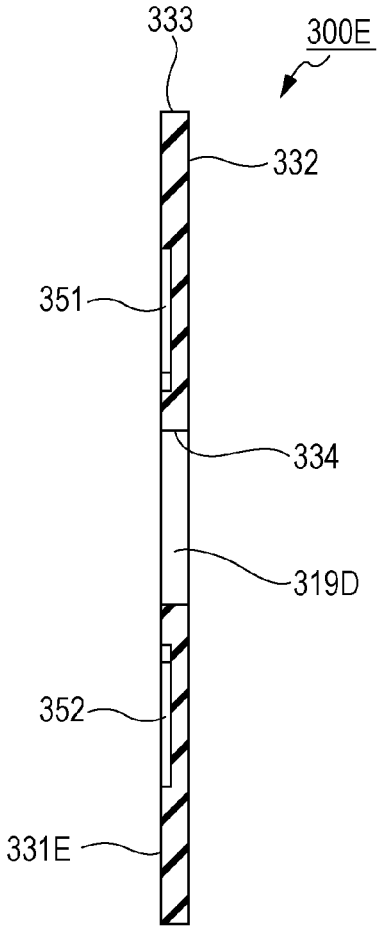
FIG. 14C is a schematic sectional view taken along line XIVC-XIVC of FIG. 14B.

FIG. 14A is a schematic perspective view illustrating an example of an insulating plate 300E. FIG. 14B is a schematic plan view illustrating the insulating plate 300E. FIG. 14C is a schematic sectional view taken along line XIVC-XIVC of FIG. 14B. The insulating plate 300E will be discussed below with reference to FIGS. 2A and 14A through 14C. Elements having the same functions as those of the seventh embodiment are designated by like reference numerals, and thus, an explanation thereof will be omitted.

As in the seventh embodiment, the insulating plate 300E includes a second surface 332, an outer periphery 333, and an inner periphery 334. In the insulating plate 300E, the axial hole 319D and first through fourth through-holes 341 through 344 are formed.

The insulating plate 300E also includes a first surface 331E opposite the second surface 332. In the first surface 331E, first and second grooves 351 and 352 are formed. For example, in the first groove 351, a band portion of the conductor band 200 extending between the first and second through-holes 341 and 342 is held, and in the second groove 352, a band portion of the conductor band 200 extending between the third and fourth through-holes 343 and 344 is held.

If the folding pattern of the conductor band 200 discussed with reference to FIG. 2A is employed, one of the band portions of the conductor band 200 extends along one of the first and second grooves 351 and 352. If the folding pattern discussed in the sixth embodiment is employed, band portions of the conductor band 200 are held in both of the first and second grooves 351 and 352.

Figure 15:
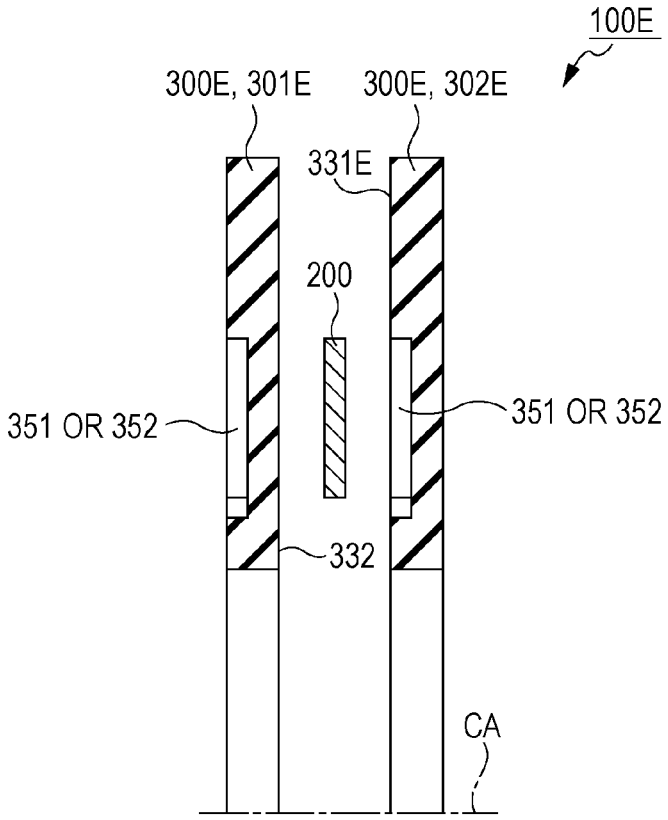
FIG. 15 is an exploded sectional view illustrating a coil structure formed by using the insulating plate shown in FIG. 14A.

FIG. 15 is an exploded sectional view illustrating a coil structure 100E formed by using the insulating plate 300E. The coil structure 100E will be discussed below with reference to FIGS. 2A and 15.

The coil structure 100E includes two insulating plates 300E and a conductor band 200. One of the two insulating plates 300E will be referred to as "a first insulating plate 301E", and the other one of the insulating plates 300E will be referred to as "a second insulating plate 302E". The first and second insulating plates 301E and 302E are aligned along the coil axis CA.

The second surface 332 of the first insulating plate 301E opposes the first surface 331 of the second insulating plate 302E. The second surface 332 of the first insulating plate 301E is an example of "a first opposing surface" in the eighth embodiment, and a first surface 331E of the second insulating plate 302E is an example of "a second opposing surface" in the eighth embodiment.

As shown in FIG. 2A, the conductor band 200 includes a straight band portion extending between the first and second folding portions 241 and 242. FIG. 15 shows a cross section of such a band portion of the conductor band 200.

The band portion of the conductor band 200 is held within the first groove 351 or the second groove 352. Accordingly, the second surface 332 of the first insulating plate 301E is in close contact with the first surface 331E of the second insulating plate 302E. Since the second surface 332 of the first insulating plate 301E closes the first and second grooves 351 and 352, the band portion of the conductor band 200 is suitably held within the first groove 351 or the second groove 352. The space within the first groove 351 or the second groove 352 closed by the second surface 332 of the first insulating plate 301E is an example of "a holding section" of the present disclosure.

In the eighth embodiment, the first and second grooves 351 and 352 are formed in the first surface 331E. Alternatively, grooves for holding conductor bands therein may be formed in both of the first and second surfaces 331E and 332.

Ninth Embodiment

In the second through eighth embodiments, four folded portions are formed in one turn section. If many folded portions are formed in one turn section, the effect of providing twisted wire is noticeably exhibited. The present inventors have found that, if five or more folded portions are formed in one turn section, power loss in a coil structure may be significantly reduced due to the effect of providing twisted wire. In a ninth embodiment, a conductor band including six folded portions in one turn section will be described.

Figure 16A:
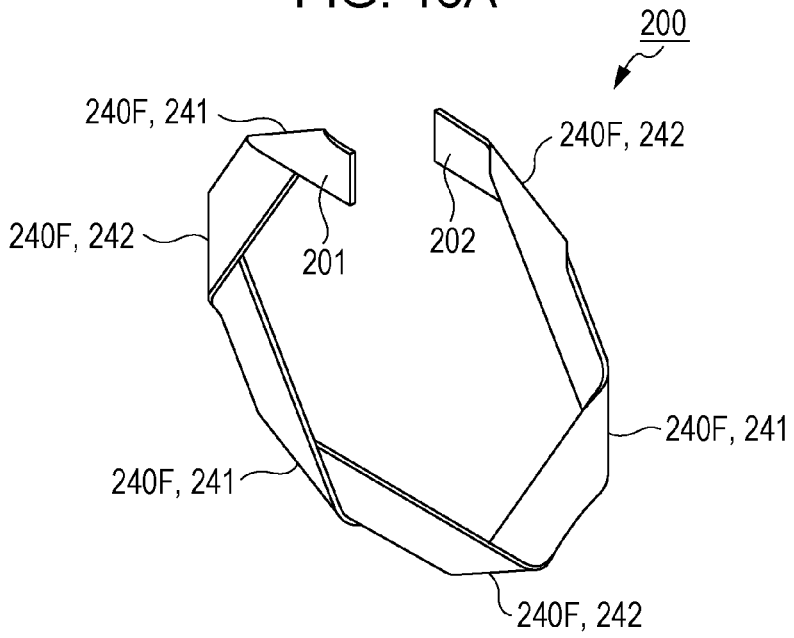
FIG. 16A is a schematic perspective view illustrating an example of a conductor band.
Figure 16B:
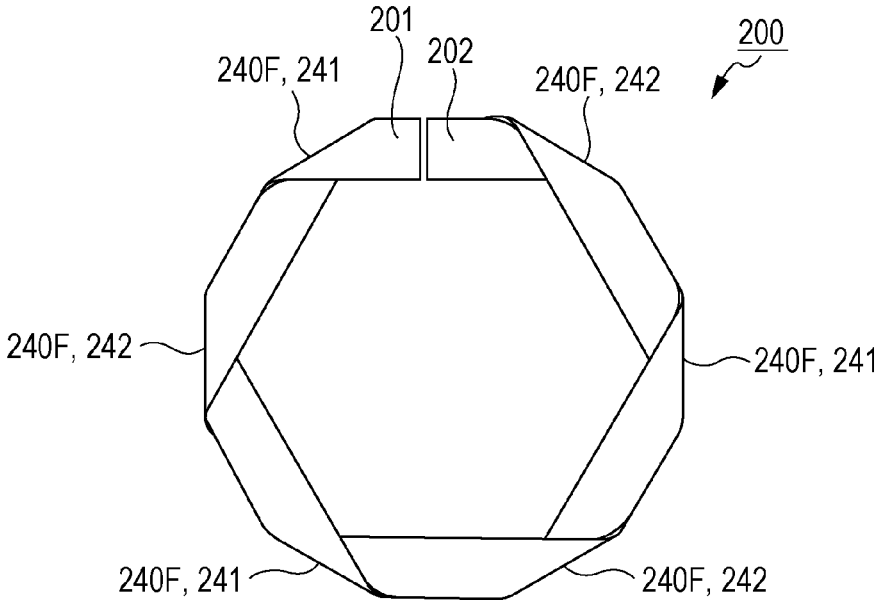
FIG. 16B is a schematic plan view illustrating the conductor band shown in FIG. 16A.

FIG. 16A is a schematic perspective view illustrating an example of the conductor band 200. FIG. 16B is a schematic plan view illustrating the conductor band 200. The conductor band 200 of the ninth embodiment will be described below with reference to FIGS. 16A and 16B. Elements having the same functions as those of the second or fifth embodiment are designated by like reference numerals, and thus, an explanation thereof will be omitted.

A manufacturer may repeatedly fold the conductor band 200 so as to form six folded portions 240F in one turn section. The six folded portions 240F may be constituted by three first folded parts 241 and three second folded parts 242. The first and second folded parts 241 and 242 may be alternately formed in a range from the start portion 201 to the end portion 202.

Figure 17A:
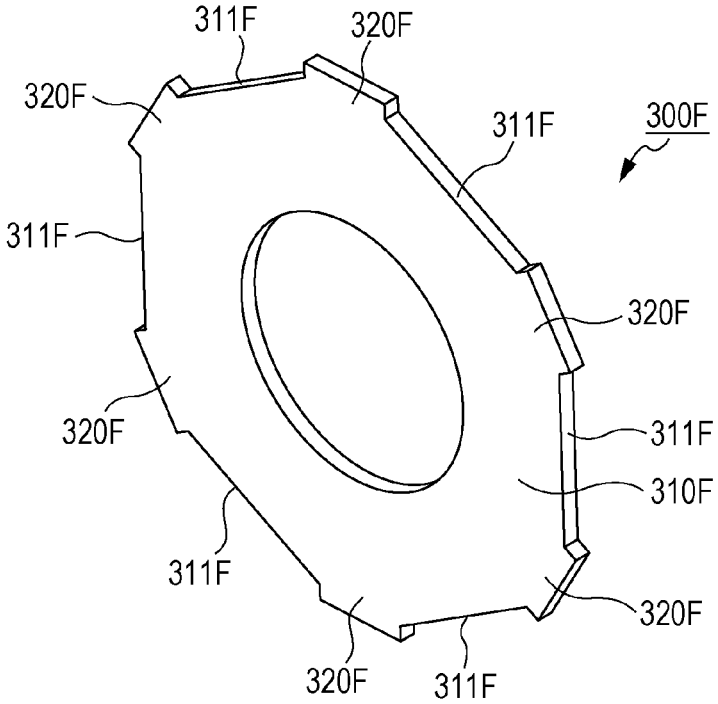
FIG. 17A is a schematic perspective view illustrating an example of an insulating plate which is combined with the conductor band shown in FIG. 16A.
Figure 17B:
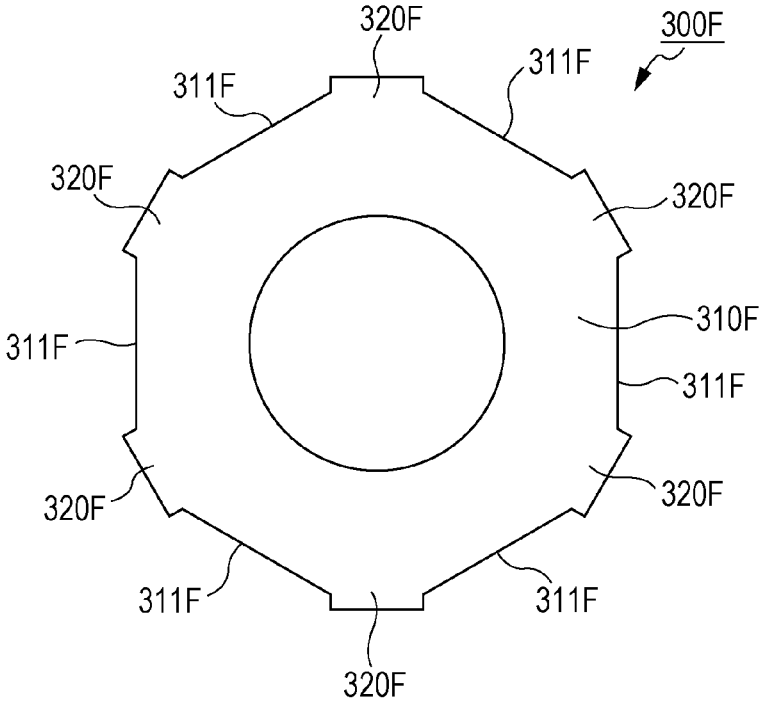
FIG. 17B is a schematic plan view illustrating the insulating plate shown in FIG. 17A.

FIG. 17A is a schematic perspective view illustrating an example of an insulating plate 300F which is combined with the folded portions 240F. FIG. 17B is a schematic plan view illustrating the insulating plate 300F. The insulating plate 300F will be discussed below with reference to FIGS. 16A through 17B.

The insulating plate 300F includes a substantially dodecagonal base portion 310F and six protruding portions 320F protruding from the base portion 310F. The base portion 310F includes six outer peripheral edges 311F. The protruding portions 320F and the outer peripheral edges 311F are alternately disposed. One of the six outer peripheral edges 311F abuts along one of the folded portions 240F shown in FIGS. 16A and 16B. Accordingly, the outer peripheral edge 311F can define the folding angle of the folded portion 240F. A pair of protruding portions 320F, between which a folded portion 240F is disposed, has surfaces opposing the side surfaces 231 and 232 of the conductor band 200 of the folded portion 240F. Accordingly, the protruding portions 320F can stably maintain the positions of the folded portions 240F. One of the outer peripheral edges 311F is an example of "a first edge portion" of the present disclosure.

Figure 18A:
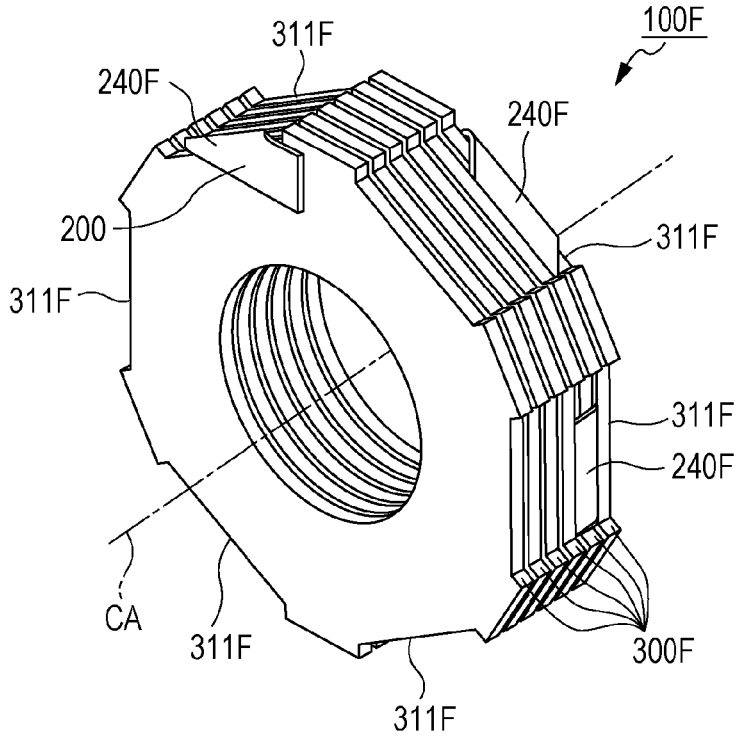
FIG. 18A is a schematic perspective view illustrating an example of a coil structure.
Figure 18B:
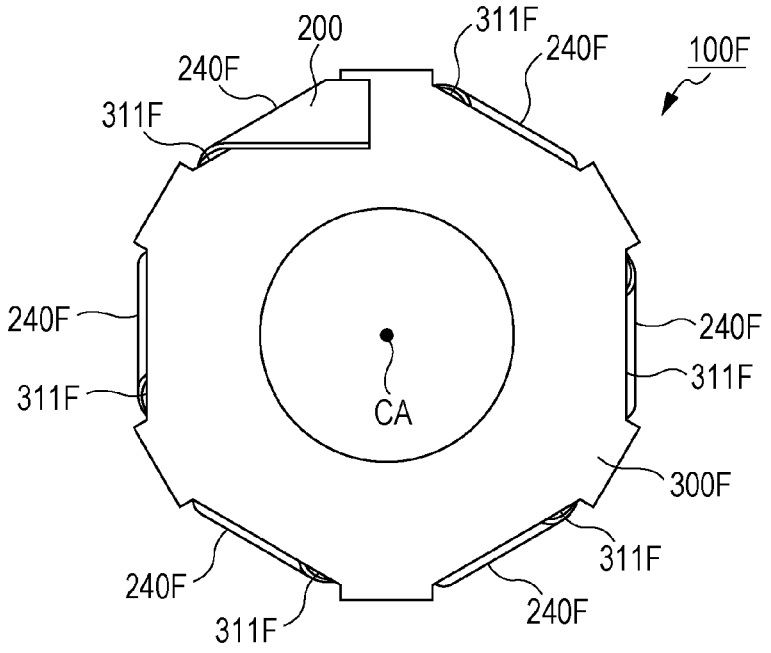
FIG. 18B is a schematic plan view illustrating the coil structure shown in FIG. 18A.

FIG. 18A is a schematic perspective view illustrating a coil structure 100F. FIG. 18B is a schematic plan view illustrating the coil structure 100F. The coil structure 100F will be described below with reference to FIGS. 18A and 18B.

The coil structure 100F includes a conductor band 200 and six insulating plates 300F. The six insulating plates 300F are aligned along the coil axis CA. One of the outer peripheral edges 311F of each of the six insulating plates 300F is used for forming one of the six folding sections 240F.

Tenth Embodiment

A coil structure is applicable to various devices. If a device into which a coil structure is integrated is designed to be small, the coil structure may be disposed near another component within the device. In this case, in terms of the safety and the reliability of the device, a long creepage distance may be required between the coil structure and another component. In a tenth embodiment, an insulating plate which makes it possible to provide a long creepage distance between a coil structure and another component will be discussed. The insulating plate in the tenth embodiment may be used instead of the insulating plate used in the ninth embodiment.

Figure 19:
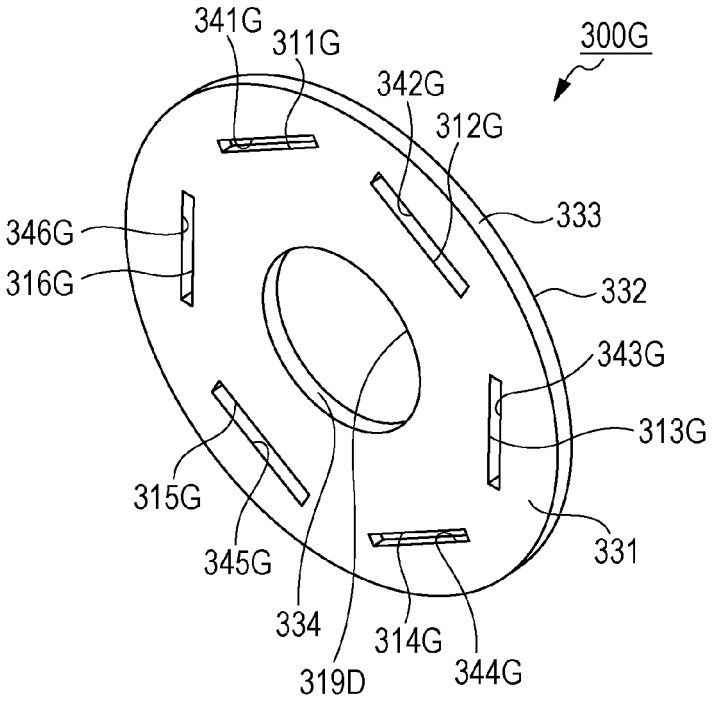
FIG. 19 is a schematic perspective view illustrating an example of an insulating plate.

FIG. 19 is a schematic perspective view illustrating an example of an insulating plate 300G. The insulating plate 300G will be discussed below with reference to FIGS. 16A and 19. Elements having the same functions as those of the seventh embodiment are designated by like reference numerals, and thus, an explanation thereof will be omitted.

As in the seventh embodiment, the insulating plate 300G includes a first surface 331, a second surface 332 opposite the first surface 331, an outer periphery 333, and an inner periphery 334. In the insulating plate 300G, an axial hole 319D is formed.

In the insulating plate 300G, first through sixth through-holes 341G through 346G are formed. The first through sixth through-holes 341G through 346G are disposed around the axial hole 319D at substantially regular intervals.

The conductor band 200 discussed with reference to FIG. 16A passes through one of the first through sixth through-holes 341G through 346G. One of the first through sixth through-holes 341G through 346G is an example of a "through-hole" of the present disclosure.

The insulating plate 300G includes edge portions 311G through 316G used for folding the conductor band 200. The edge portions 311G through 316G partially form the contours of the first through sixth through-holes 341G through 346G, respectively.

An outer area of the insulating plate 300G, positioned farther away from the coil axis CA than the first through sixth through-holes 341G through 346G, can contribute to increasing the creepage distance between a coil structure and another component disposed close to the coil structure.

Eleventh Embodiment

The coil structures discussed in the second through tenth embodiments each include a single conductor band. Alternatively, a coil structure may include a plurality of conductor bands. If multiple conductor bands are used, a user can easily supply high electrical energy to a coil structure. Thus, in the case of using multiple conductor bands, individual conductor bands may be thin. If thin conductor bands are used, electrical resistance is significantly reduced due to the effect of providing twisted wire. The user may supply electrical energy to one of the plurality of conductor bands. If, as a result of supplying electrical energy to one of the conductor bands, an induced current is generated in another conductor band, the coil structure may be used as a transformer. In an eleventh embodiment, a coil structure including two conductor bands will be described.

Figure 20:
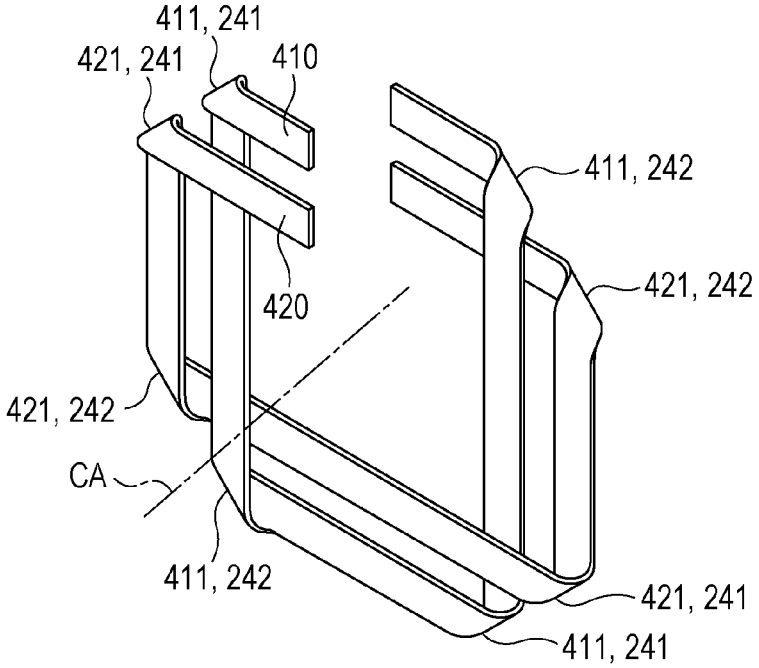
FIG. 20 is a schematic perspective view illustrating an example of a folding pattern of a plurality of conductor bands.

FIG. 20 is a schematic perspective view illustrating an example of a folding pattern of a plurality of conductor bands. A folding pattern of a plurality of conductor bands will be discussed below with reference to FIG. 20. Elements having the same functions as those of the fifth embodiment are designated by like reference numerals, and thus, an explanation thereof will be omitted.

FIG. 20 includes a first conductor band 410 and a second conductor band 420. The first conductor band 410 has one turn section which turns around the coil axis CA through one revolution. The second conductor band 410 also has one turn section which turns around the coil axis CA through one revolution. The first and second conductor bands 410 and 420 may each have multiple turn sections. The number of turn sections is not restricted.

The first conductor band 410 includes four folded portions 411 within one turn section. The four folded portions 411 are constituted by two first folded parts 241 and two second folded parts 242. The first folded parts 241 and the second folded parts 242 are alternately formed.

The second conductor band 420 includes four folded portions 421 within one turn section. The four folded portions 421 are constituted by two first folded parts 241 and two second folded parts 242. The first folded parts 241 and the second folded parts 242 are alternately formed.

FIGS. 21A through 21H schematically illustrate the first and second conductor bands 410 and 420 which are folded by using insulating plates 301 through 304. A manufacturing method for a coil structure 100H will be described below with reference to FIGS. 21A through 21H.

The first and second conductor bands 410 and 420 are sequentially folded along edge portions 312 through 315. In the process in which the first and second conductor bands 410 and 420 are being folded, the first and second conductor bands 410 and 420 are each constituted by a portion extending in the X-axis direction and a portion extending in the Y-axis direction.

The first conductor band 410 has a start portion 412 and an end portion 413 opposite to the start portion 412. The first conductor band 410 has one turn section between the start portion 412 and the end portion 413.

The second conductor band 420 has a start portion 422 and an end portion 423 opposite to the start portion 422. The second conductor band 420 has one turn section between the start portion 422 and the end portion 423.

Figure 21A:
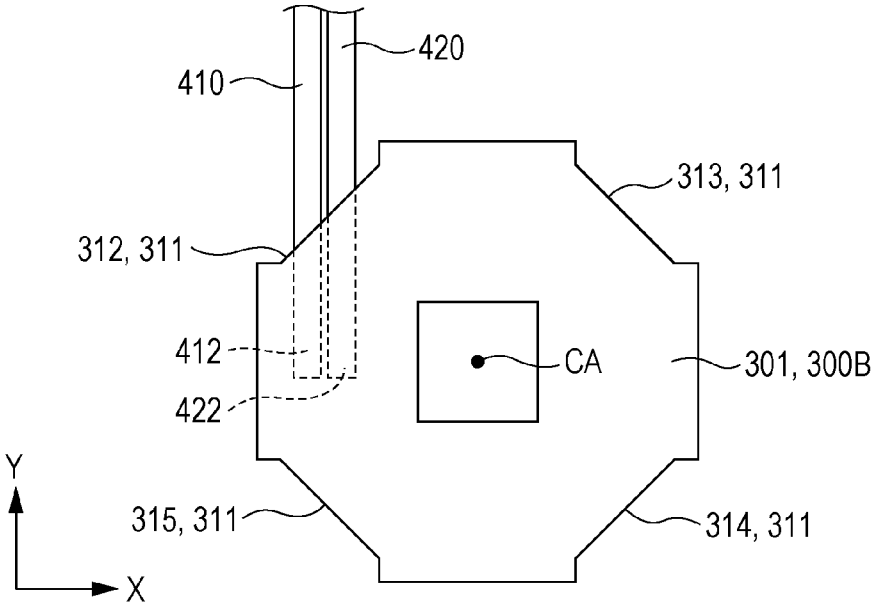
FIGS. 21A through 21H are schematic views illustrating examples of steps for folding first and second conductor bands.
Figure 21B:
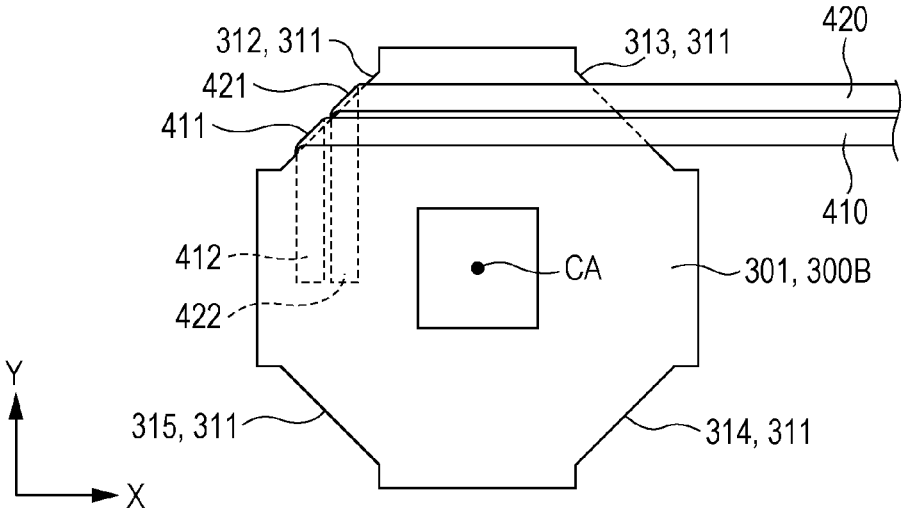

As shown in FIG. 21A, a manufacturer disposes the second conductor band 420 next to the first conductor band 410. In FIG. 21A, both of the first and second conductor bands 410 and 420 extend in the Y-axis positive direction. The manufacturer then superposes an insulating plate 301 on the start portions 412 and 422. Then, as shown in FIG. 21B, the manufacturer folds the first and second conductor bands 410 and 420 along the edge portion 312. As a result, a folded portion 411 of the first conductor band 410 is formed, and a folded portion 421 of the second conductor band 420 is formed.

Figure 21C:
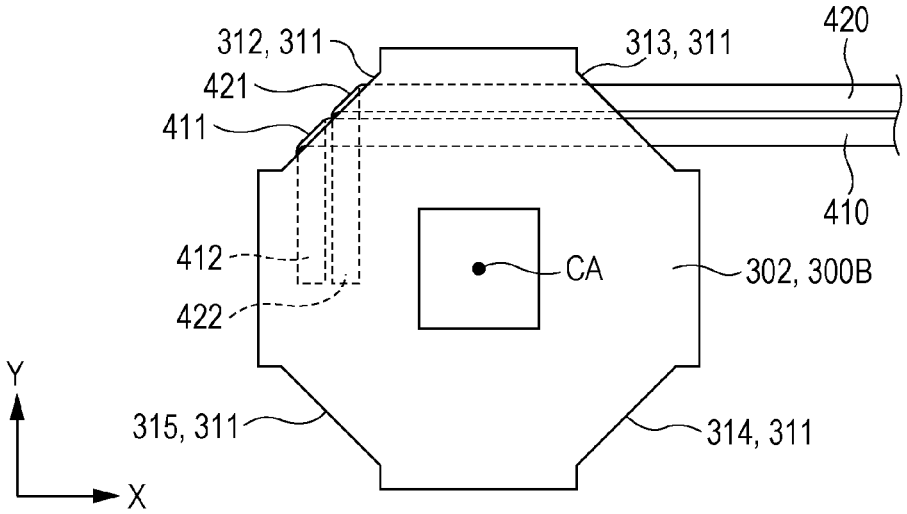
Figure 21D:
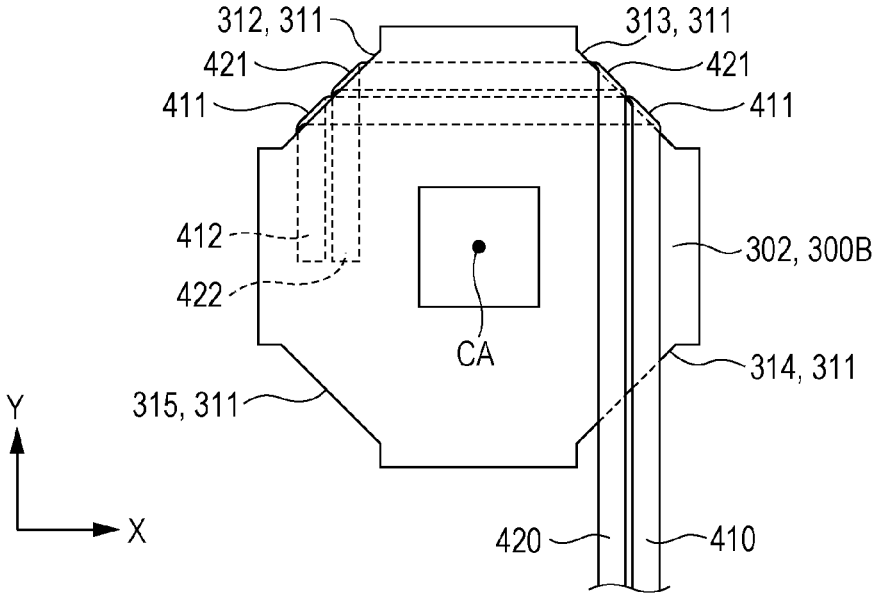

After forming the folded portions 411 and 421, as shown in FIG. 21C, the manufacturer superposes an insulating plate 302 on the insulating plate 301. As a result, the first and second conductor bands 410 and 420 positioned between the edge portions 312 and 313 are sandwiched between the insulating plates 301 and 302. Then, as shown in FIG. 21D, the manufacturer folds the first and second conductor bands 410 and 420 along the edge portion 313. As a result, a folded portion 411 of the first conductor band 410 is formed, and a folded portion 421 of the second conductor band 420 is formed.

Figure 21E:
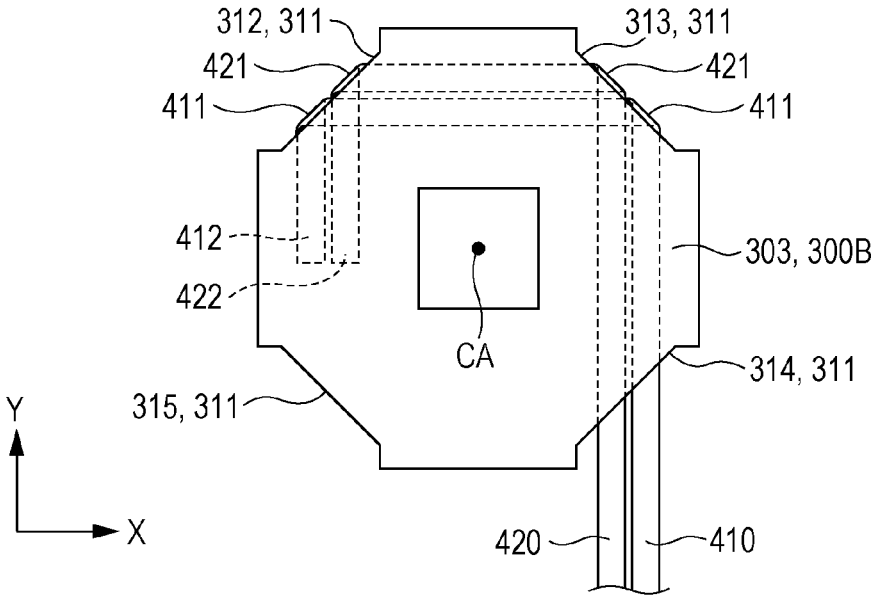
Figure 21F:
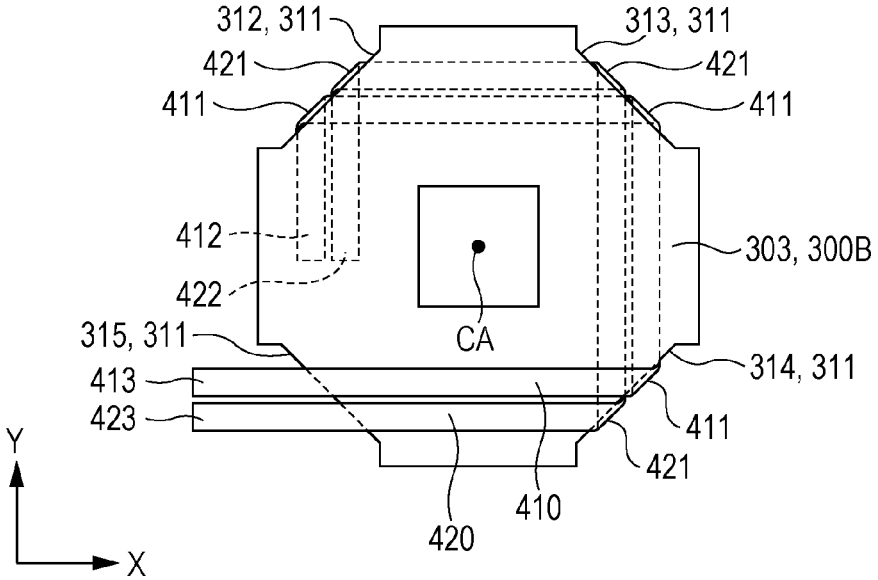

After forming the folded portions 411 and 421, as shown in FIG. 21E, the manufacturer superposes an insulating plate 303 on the insulating plate 302. As a result, the first and second conductor bands 410 and 420 positioned between the edge portions 313 and 314 are sandwiched between the insulating plates 302 and 303. Then, as shown in FIG. 21F, the manufacturer folds the first and second conductor bands 410 and 420 along the edge portion 314. As a result, a folded portion 411 of the first conductor band 410 is formed, and a folded portion 421 of the second conductor band 420 is formed.

Figure 21G:
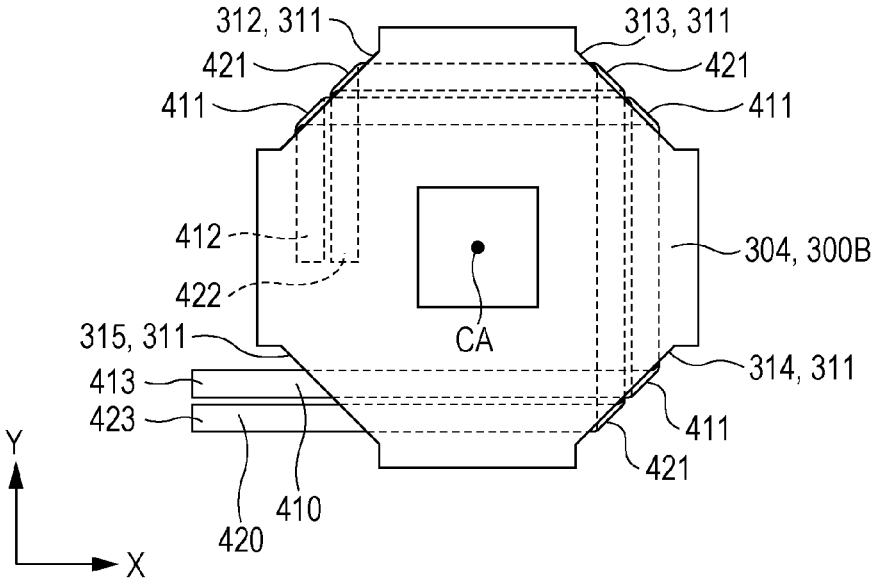
Figure 21H:
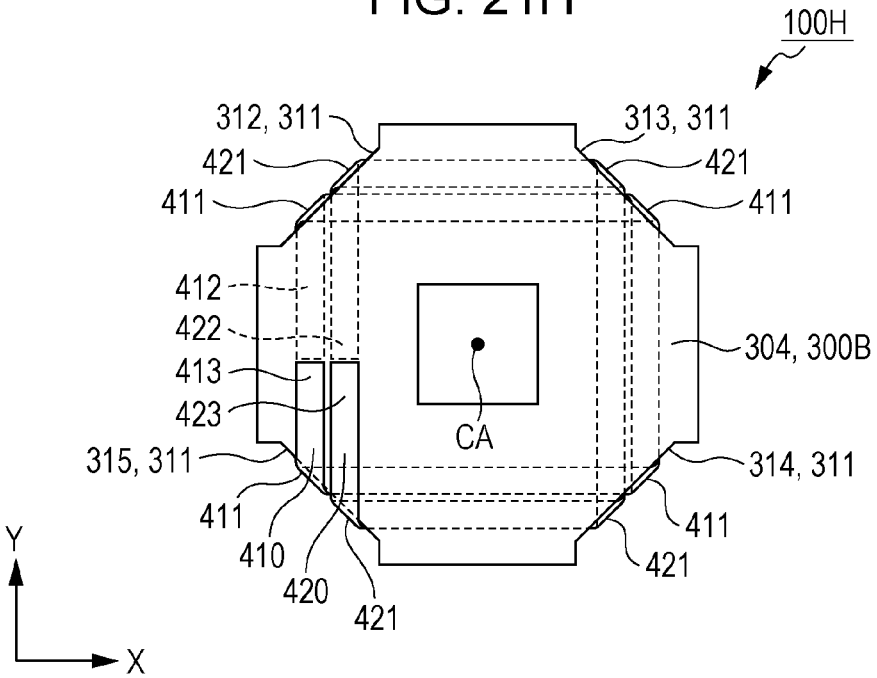

After forming the folded portions 411 and 421, as shown in FIG. 21G, the manufacturer superposes an insulating plate 304 on the insulating plate 303. As a result, the first and second conductor bands 410 and 420 positioned between the edge portions 314 and 315 are sandwiched between the insulating plates 303 and 304. Then, as shown in FIG. 21H, the manufacturer folds the first and second conductor bands 410 and 420 along the edge portion 315. As a result, a folded portion 411 of the first conductor band 410 is formed, and a folded portion 421 of the second conductor band 420 is formed.

The edge portions 312 through 315 abut along the four respective folded portions 411. The edge portions 312 through 315 also abut along the four respective folded portions 421. The four folded portions 411 are examples of "a first plurality of folded portions" in the eleventh embodiment. The four folded portions 421 are examples of "a second plurality of folded portions" in the eleventh embodiment. One of the edge portions 312 through 315 is an example of "a first edge portion" in the eleventh embodiment.

Twelfth Embodiment

In the eleventh embodiment, each of the insulating plates has a plurality of edge portions. The first and second conductor bands 410 and 420 are folded by using the common edge portions. Alternatively, a second conductor band may be folded by using an edge portion different from an edge portion used for folding a first conductor band. In this case, the second conductor band defines a spiral path different from that of the first conductor band. Accordingly, the first and second conductor bands may be constituted by thick metallic bands. In a twelfth embodiment, a coil structure including first and second conductor bands that define different spiral paths will be described. If a user supplies electrical energy to one of the first and second conductor bands, an induced current is generated in the other one of the first and second conductor bands, and thus, the coil structure may be used as a transformer.

Figure 22:
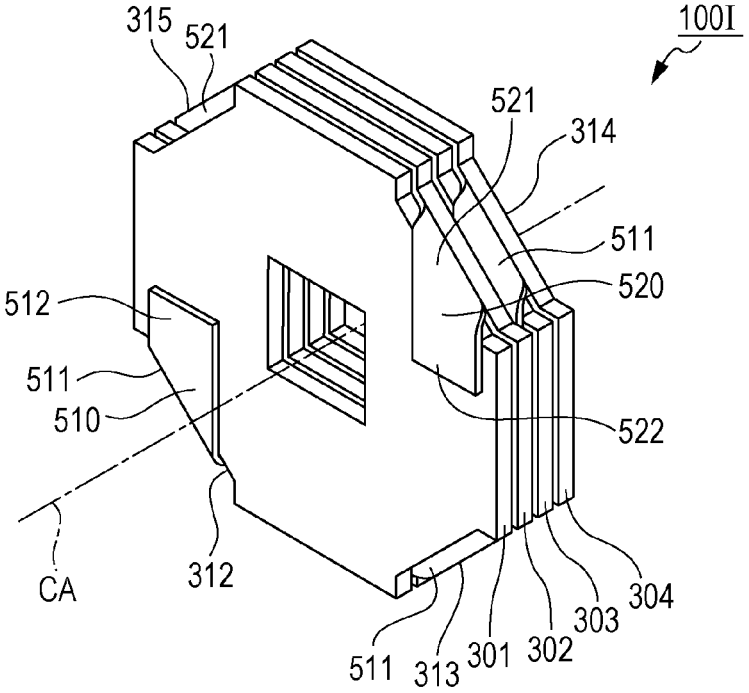
FIG. 22 is a schematic perspective view illustrating an example of a coil structure.
Figure 23:
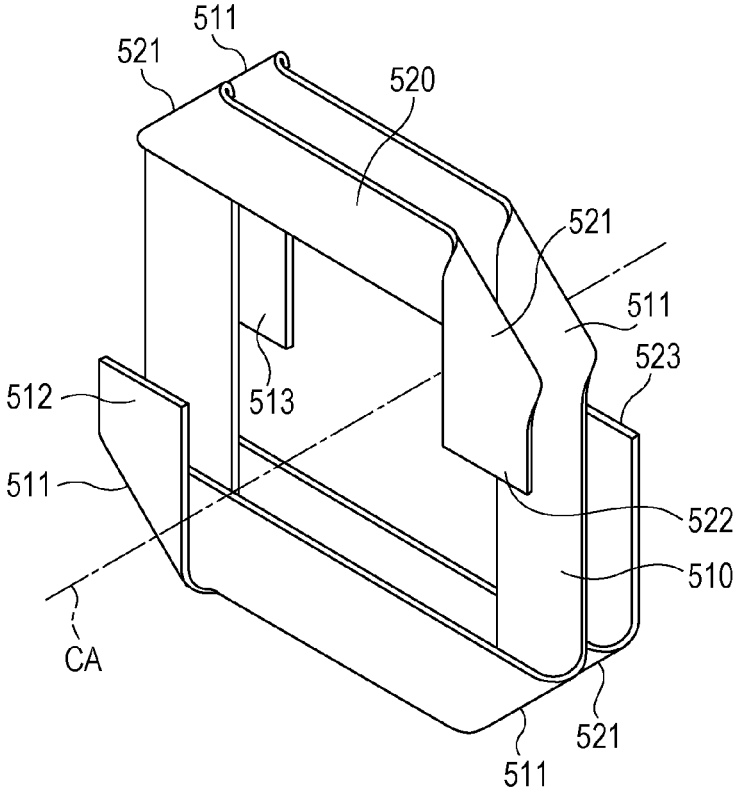
FIG. 23 is a schematic perspective view illustrating an example of a folding pattern of first and second conductor bands.

FIG. 22 is a schematic perspective view illustrating an example of a coil structure 100I. FIG. 23 is a schematic perspective view illustrating an example of a folding pattern of a plurality of conductor bands. A folding pattern of a plurality of conductor bands will be discussed below with reference to FIGS. 22 and 23. Elements having the same functions as those of the eleventh embodiment are designated by like reference numerals, and thus, an explanation thereof will be omitted.

As in the eleventh embodiment, the coil structure 100I includes insulating plates 301 through 304. The coil structure 100I includes a first conductor band 510 and a second conductor band 520.

The first conductor band 510 has a start portion 512 and an end portion 513 opposite to the start portion 512. The first conductor band 510 has one turn section between the start portion 512 and the end portion 513. The first conductor band 510 may have multiple turn sections. The number of turn sections is not restricted.

The second conductor band 520 has a start portion 522 and an end portion 523 opposite to the start portion 522. The second conductor band 520 has one turn section between the start portion 522 and the end portion 523. The second conductor band 520 may have multiple turn sections. The number of turn sections is not restricted.

The start portion 522 of the second conductor band 520 is disposed symmetrically to the start portion 512 of the first conductor band 510 about the coil axis CA, for example. In this case, the end portion 523 of the second conductor band 520 is disposed symmetrically to the end portion 513 of the first conductor band 510 about the coil axis CA. Accordingly, the turning phase of the second conductor band 520 around the coil axis CA is out of phase from that of the first conductor band 510 by 180°. The phase difference between the first and second conductor bands 510 and 520 is not restricted to 180°.

The first conductor band 510 includes a folded portion 511 folded by using the edge portion 312 of the insulating plate 301. The second conductor band 520 includes a folded portion 521 folded by using the edge portion 314 of the insulating plate 301. The edge portion 312 abuts along the folded portion 511 of the first conductor band 510, while the edge portion 314 opposite the edge portion 312 abuts along the folded portion 521 of the second conductor band 520.

The first conductor band 510 includes a folded portion 511 folded by using the edge portion 313 of the insulating plate 302. The second conductor band 520 includes a folded portion 521 folded by using the edge portion 315 of the insulating plate 302. The edge portion 313 abuts along the folded portion 511 of the first conductor band 510, while the edge portion 315 opposite the edge portion 313 abuts along the folded portion 521 of the second conductor band 520.

The first conductor band 510 includes a folded portion 511 folded by using the edge portion 314 of the insulating plate 303. The second conductor band 520 includes a folded portion 521 folded by using the edge portion 312 of the insulating plate 303. The edge portion 314 abuts along the folded portion 511 of the first conductor band 510, while the edge portion 312 opposite the edge portion 314 abuts along the folded portion 521 of the second conductor band 520.

The first conductor band 510 includes a folded portion 511 folded by using the edge portion 315 of the insulating plate 304. The second conductor band 520 includes a folded portion 521 folded by using the edge portion 313 of the insulating plate 304. The edge portion 315 abuts along the folded portion 511 of the first conductor band 510, while the edge portion 313 opposite the edge portion 315 abuts along the folded portion 521 of the second conductor band 520.

The four folded portions 511 are examples of "a first plurality of folded portions" in the twelfth embodiment. The four folded portions 521 are examples of "a second plurality of folded portions" in the twelfth embodiment. When the edge portion 312 is an example of "a first edge portion", the edge portion 314 is an example of "a different edge portion" in the twelfth embodiment. When the edge portion 313 is an example of "a first edge portion", the edge portion 315 is an example of "a different edge portion" in the twelfth embodiment. When the edge portion 314 is an example of "a first edge portion", the edge portion 312 is an example of "a different edge portion" in the twelfth embodiment. When the edge portion 315 is an example of "a first edge portion", the edge portion 313 is an example of "a different edge portion" in the twelfth embodiment.

Thirteenth Embodiment

The coil structures formed based on the above-described various embodiments may be integrated, as a transformer, such as a voltage converter or a shift converter, into a power converter for converting an alternating current into a direct current. In this case, a power converter may be integrated into a charger for storing electrical energy therein. In a thirteenth embodiment, a power converter including one or more of the coil structures formed based on the above-described various embodiments will be described.

Figure 24:
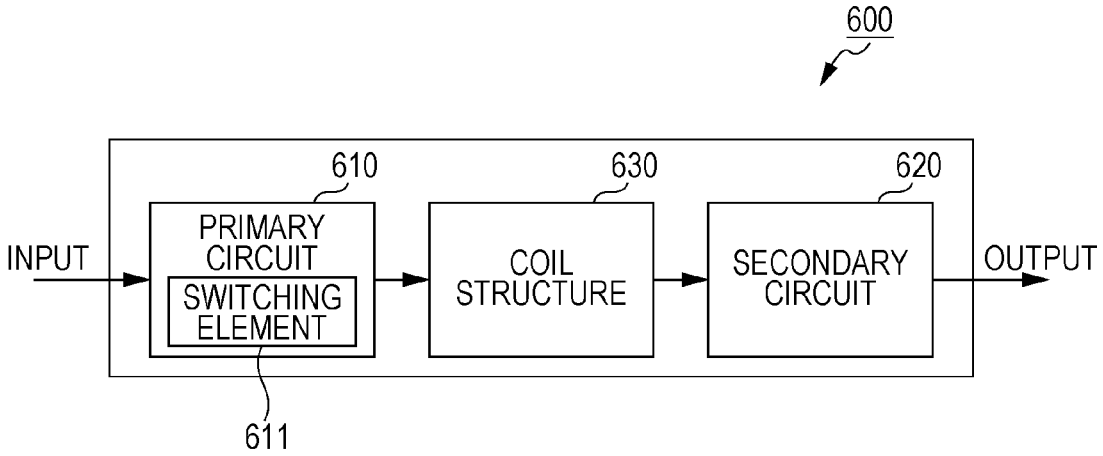
FIG. 24 is a schematic block diagram illustrating an example of a power converter.

FIG. 24 is a schematic block diagram illustrating an example of a power converter 600. The power converter 600 will be described below with reference to FIG. 24.

The power converter 600 includes a primary circuit 610, a secondary circuit 620, and a coil structure 630. The primary circuit 610 includes a switching element 611. For stabilizing the voltage of the secondary circuit 620, ON/OFF timings of the switching element 611 may be adjusted. The primary circuit 610 is an example of "a switching circuit" of the present disclosure.

The coil structure 630 may be formed on the basis of one of the above-described various embodiments. Alternatively, the coil structure 630 may be formed by a combination of the above-described various embodiments.

The coil structure 630 may function as a transformer for insulating the secondary circuit 620 from the primary circuit 610.

The power converter 600 may convert an alternating current input into the primary circuit 610 into a direct current. In this case, the power converter 600 may be integrated into a charger.

The present disclosure is suitably used for various devices utilizing electromagnetic induction.

While the present disclosure has been described with respect to exemplary embodiments thereof, it will be apparent to those skilled in the art that the disclosure may be modified in numerous ways and may assume many embodiments other than those specifically described above. Accordingly, it is intended by the appended claims to cover all modifications of the disclosure that fall within the true spirit and scope of the disclosure.

What is claimed is:

1. A coil structure comprising:

a conductor band that includes a plurality of folded portions, the conductor band turning around a coil axis while being folded at the plurality of folded portions; and a first insulating plate around which at least part of the conductor band is wound, the first insulating plate including a first edge portion which abuts along at least one of the plurality of folded portions such that the at least one of the plurality of folded portions extends radially inward to abut at least one of opposing surfaces of the first insulating plate connected by the first edge portion.

2. The coil structure according to claim 1, wherein:

the conductor band includes a first band surface and a second band surface opposite to the first band surface;

the plurality of folded portions include a plurality of first folded parts in each of which part of the first band surface is folded inwardly and a plurality of second folded parts in each of which part of the second band surface is folded inwardly; and each of the plurality of first folded parts and each of the plurality of second folded parts are alternately disposed in a direction in which the conductor band extends.

3. The coil structure according to claim 1, further comprising:

a second insulating plate opposed to the first insulating plate, wherein the conductor band includes a first band surface and a second band surface opposite to the first band surface, the plurality of folded portions include a first folded part where part of the first band surface is folded inwardly and a second folded part where part of the second band surface is folded inwardly, the first insulating plate includes the first edge portion which abuts along the first folded part, the second insulating plate includes a second edge portion which abuts along the second folded part, the conductor band includes a band portion which extends between the first and second folded parts, and the band portion is sandwiched between the first and second insulating plates.

4. The coil structure according to claim 1, further comprising:

a plurality of insulating plates including the first insulating plate, wherein the plurality of insulating plates are as many as or greater than the plurality of folded portions.

5. The coil structure according to claim 3, further comprising:

a magnetic core extending in a direction along the coil axis, wherein the first insulating plate includes a first axial hole through which the magnetic core passes, and the second insulating plate includes a second axial hole through which the magnetic core passes.

6. The coil structure according to claim 1, wherein:

the first insulating plate includes a first principal surface and a second principal surface opposite to the first principal surface; and the first edge portion is part of a side surface which connects a contour of the first principal surface and a contour of the second principal surface.

7. The coil structure according to claim 1, wherein:
the first insulating plate includes a through-hole through which the conductor band passes; and
the first edge portion is part of an inner peripheral surface which defines the through-hole.

8. The coil structure according to claim 1, wherein:
the conductor band includes a first band surface and a second band surface opposite to the first band surface;
the plurality of folded portions include a plurality of folded parts in each of which part of the first band surface is folded inwardly;
the conductor band includes a turn section that turns around the coil axis through one revolution while being folded at the plurality of folded parts;
the first insulating plate includes a plurality of edge portions including the first edge portion, and
the plurality of folded parts are folded along the plurality of edge portions.

9. The coil structure according to claim 1, further comprising:
a second insulating plate, wherein
the conductor band includes a band portion which extends between the plurality of folded portions, the band portion being sandwiched between the first and second insulating plates, and
at least one of the first and second insulating plates includes a holding section for holding the band portion therein, at a position at which the holding section opposes the band portion.

10. The coil structure according to claim 2, wherein:
the plurality of folded portions include five or more folded portions;
the conductor band includes a turn section that turns around the coil axis through one revolution while being folded at the five or more folded portions; and
each of the plurality of first folded parts and each of the plurality of second folded parts are alternately disposed in a direction in which the turn section extends.

11. The coil structure according to claim 1, wherein:
the plurality of folded portions are a first plurality of folded portions;
the conductor band is a first conductor band;
the coil structure further comprises a second conductor band that turns around the coil axis while being folded at a second plurality of folded portions; and
at least one of the second plurality of folded portions is folded along the first edge portion.

12. The coil structure according to claim 1, wherein:
the plurality of folded portions are a first plurality of folded portions;
the conductor band is a first conductor band;
the coil structure further comprises a second conductor band that turns around the coil axis while being folded at a second plurality of folded portions;
the first insulating plate includes a different edge portion from the first edge portion; and
at least one of the second plurality of folded portions is folded along the different edge portion.

13. The coil structure according to claim 1, wherein:
the conductor band includes a band portion extending between two adjacent folded portions which are included in the plurality of folded portions; and
a line normal to a principal surface of the band portion is parallel with the coil axis.

14. The coil structure according to claim 1, wherein the insulating plate has a higher folding stiffness than the conductor band.

15. A transformer comprising:
the coil structure according to claim 11,
wherein, when a current is supplied to one of the first and second conductor bands, an induced current is generated in the other one of the first and second conductor bands.

16. A transformer comprising:
the coil structure according to claim 12,
wherein, when a current is supplied to one of the first and second conductor bands, an induced current is generated in the other one of the first and second conductor bands.

17. The coil structure according to claim 1, further comprising:
a first plurality of insulating plates including the first insulating plate; and
a second plurality of insulating plates, wherein
the plurality of folded portions include a plurality of first folded portions and a plurality of second folded portions;
the conductor band includes:
a first turn section that turns around a coil axis through one revolution while being folded at the plurality of first folded portions, and
a second turn section that turns around the coil axis through one revolution while being folded at the plurality of second folded portions, the second turn section being connected to one end of the first turn section; and
the first turn section is wound around the first plurality of insulating plates, and the second turn section is wound around the second plurality of insulating plates.

18. The coil structure according to claim 1, wherein the at least one of the plurality of folded portions abuts both of the opposing surfaces of the first insulating plate.

19. The coil structure according to claim 3, wherein the conductor band is in direct contact with the first and second insulating plates.

* * * * *